US006375412B1

(12) United States Patent
Dial

(10) Patent No.: US 6,375,412 B1
(45) Date of Patent: Apr. 23, 2002

(54) VISCOUS DRAG IMPELLER COMPONENTS INCORPORATED INTO PUMPS, TURBINES AND TRANSMISSIONS

(76) Inventor: Daniel Christopher Dial, SE. 141 Mill Creek Rd., Shelton, WA (US) 98584

( * ) Notice: Subject to any disclaimer, the term of this patent is extended or adjusted under 35 U.S.C. 154(b) by 0 days.

(21) Appl. No.: 09/471,705

(22) Filed: Dec. 23, 1999

(51) Int. Cl.[7] ..... F01D 1/36

(52) U.S. Cl. ..... 415/90; 415/121.2; 415/149.1; 415/155; 415/160; 415/202; 415/229; 416/4; 416/198 A; 416/198 R; 416/223 B

(58) Field of Search ..... 415/56.2, 80, 90, 415/121.2, 149.1, 151, 159, 160, 206, 229, 202, 902, 155; 416/4, 185, 198 A, 198 R, 223 B

(56) References Cited

U.S. PATENT DOCUMENTS

| | | | | | |
|---|---|---|---|---|---|
| 1,013,248 | A | | 1/1912 | Wilkinson | |
| 1,061,142 | A | | 5/1913 | Tesla | |
| 1,061,206 | A | | 5/1913 | Tesla | |
| 2,321,907 | A | | 6/1943 | Gent | 230/129 |
| 2,622,859 | A | | 12/1952 | Gettins | 261/84 |
| 2,850,229 | A | | 9/1958 | Stalker | 230/134 |
| 2,924,439 | A | | 2/1960 | Dutton, Jr. | 259/7 |
| 2,952,448 | A | | 9/1960 | Cornell | 259/9 |
| 3,017,848 | A | * | 1/1962 | Bishop | 415/90 |
| 3,037,459 | A | | 6/1962 | Nelden | 103/115 |
| 3,226,012 | A | | 12/1965 | Trask | 230/117 |
| 3,275,223 | A | | 9/1966 | Fowell | 230/125 |
| 3,610,770 | A | * | 10/1971 | Hendriks | 415/203 |
| 3,923,417 | A | * | 12/1975 | Swiecicki | 415/110 |
| 4,036,584 | A | * | 7/1977 | Glass | 415/90 |
| 4,218,177 | A | * | 8/1980 | Robel | 415/90 |
| 4,347,032 | A | * | 8/1982 | Possell | 415/90 |
| 4,403,911 | A | * | 9/1983 | Possell | 415/90 |
| 4,609,327 | A | * | 9/1986 | Nishimori | 415/121.2 |
| 4,773,819 | A | * | 9/1988 | Gurth | 415/90 |
| 5,118,961 | A | | 6/1992 | Gamell | 290/52 |
| 5,191,247 | A | * | 3/1993 | Possell | 310/62 |
| 5,192,182 | A | | 3/1993 | Possell | 415/90 |
| 5,192,183 | A | | 3/1993 | Wilkinson | 415/90 |
| 5,224,821 | A | | 7/1993 | Ozawa | 416/169.1 |
| 5,297,926 | A | | 3/1994 | Negishi | 415/90 |
| 5,372,499 | A | | 12/1994 | Motomura et al. | 432/176 |
| 5,388,958 | A | | 2/1995 | Dinh | 415/90 |
| 5,419,679 | A | | 5/1995 | Gaunt et al. | 415/90 |
| 5,470,197 | A | | 11/1995 | Cafarelli | 415/90 |
| 6,071,072 | A | * | 6/2000 | Chang | 415/56.2 |

OTHER PUBLICATIONS

Search Report dated Mar. 29, 2001 for International Patent Application No. PCT/US00/3551; filed 20 Dec.20, 2000; In re DIAL, Daniel Christopher.

* cited by examiner

*Primary Examiner*—Edward K. Look
*Assistant Examiner*—Ninh Nguyen
(74) *Attorney, Agent, or Firm*—Ann W. Speckman; James E. Klaniecki

(57) ABSTRACT

The present invention is for the efficient transfer of mechanical power through a fluid medium. The various embodiments of the present invention exploit the natural physical properties of fluids to create a more efficient means of driving fluids as well as transferring power from propelled fluids. The present invention employs an impeller assembly in a variety of applications including hydroelectric turbines, fluid turbines, turbine transmissions and pumps of various types. The multi-disk impeller assembly having a central cavity, a specialized central hub design and reinforcing backing plates contribute to greater efficiency and less turbulence, friction and noise.

24 Claims, 12 Drawing Sheets

VISCOUS DRAG IMPELLER COMPONENTS INCORPORATED INTO PUMPS, TURBINES AND TRANSMISSIONS

BACKGROUND OF THE INVENTION

1. Field of the Invention.

The present invention relates generally to an improved design for transferring mechanical power through the use of a fluid medium. The present invention employs an impeller system in a variety of applications including hydroelectric turbines, fluid turbines, fluid transmissions and pumps of various types.

2. Description of Prior Art.

Various forms of impeller systems have been employed in a diversity of inventions, including turbines, pumps, fans, compressors, homogenizers, as well as other devices. The common link between these devices is the displacement of fluid, in either a gaseous or liquid state.

Impeller systems may be broadly categorized as having either a single rotor assembly, such as a water pump (U.S. Pat. No. 5,224,821) or homogenizer (U.S. Pat. No. 2,952,448); or a single radially arranged multi-vaned assembly, such as a fan or blower (U.S. Pat. No. 5,372,499); or a multi-disk assembly mounted on a central shaft, as in a laminar flow fan (U.S. Pat. No. 5,192,183). Impeller systems employing vanes, blades, paddles, etc. operate by colliding with and pushing the fluid being displaced. This type of operation introduces shocks and vibrations to the fluid medium resulting in turbulence, which impedes the movement of the fluid and ultimately reduces the overall efficiency of the system. One of the inherent advantages of a multi-disc impeller system is obviating this deficiency by imparting movement to the fluid medium in such a manner as to allow movement along natural lines of least resistance, thereby reducing turbulence.

U.S. Pat. No. 1,061,142 describes an apparatus for propelling or imparting energy to fluids comprising a runner set having a series of spaced discs fixed to a central shaft. The discs are centrally attached to the shaft running perpendicular to the discs. Each disk has a number of central openings, with solid portions in-between to form spokes, which radiate inwardly to the central hub, through which the shaft runs, providing the only means of support for the discs.

Similarly, U.S. Pat. No. 1,061,206 discloses the application of a runner set similar to that described above for use in a turbine or rotary engine. The runner set comprises a series of discs which have central openings with spokes connecting the body of the disc to the central shaft. As in the aforementioned patent, the only means of support for the discs is the connection to the central shaft.

U.S. Pat. No. 5,118,961 describes an fluid driven turbine generator utilizing a single rotor having magnets secured in a receptacle shaped portion and spinning about a stationary core to produce electricity. Fluid jets drive the single rotor by impinging on a circumferential roughened surface of the receptacle shaped portion of the rotor. The present invention is distinct from the above in that it employs a multi-disc impeller system rather than a single rotor.

There is a need in the art for a more efficient means of displacing fluids and generating power from propelled fluids without introducing unnecessary turbulence to the fluid medium and loss of energy transfer through heat and vibration. The present invention alleviates the shortcomings of the art and is distinct from other pumps, turbines and transmissions. The present invention provides a compact, efficient and versatile system for driving fluids and generating power from propelled fluids.

SUMMARY OF THE INVENTION

The present invention is for the efficient transfer of mechanical power through a fluid medium. The various embodiments of the present invention exploit the natural physical properties of fluids to create a more efficient means of driving fluids as well as transferring power from propelled fluids.

The design of the discs and runner set of the Tesla pump and turbine have significant shortcomings. The discs have a central aperture with spokes radiating inwardly to a central hub, which is fixedly mounted to a perpendicular shaft. The only means of support for the discs are the spokes radiating to the central shaft. The disc design, the use of a centrally located shaft, and the means of connecting the disks to the central shaft, individually, and especially in combination, create turbulence in the fluid medium, resulting in inefficiency. As the disks are driven through a fluid medium, as in a pump, or caused to be driven by a fluid medium, as in a turbine, the spokes collide with the fluid causing turbulence, which is transmitted to the fluid in the form of heat and vibration. In addition, the spoke arrangement creates cavitation in the fluid medium causing pitting or other damage to the surfaces of other components. Furthermore, the arrangement of the runner set does not sufficiently support the discs during operation, resulting in a less efficient system. Finally, the arrangement of the shaft through the middle of the discs interferes with the natural path of the fluid causing excessive turbulence and loss of efficiency.

According to one aspect of the present invention, a Turbopump system is provided. The Turbopump system may be used to displace all forms of fluids, whether liquid or gaseous, and is equally well suited for high volume and/or high pressure applications as well as low to medium pressure applications. Within the housing of the Turbopump is an impeller assembly possessing a series of parallel flat disks arranged perpendicularly along a rotational axis to a central hub. Each disk has a central aperture, and the parallel arrangement of multiple disks creates a central cavity of the impeller assembly. The disks are arranged on the central hub with spaces between to allow fluid to be drawn through the central cavity of the impeller assembly, as well as between individual disks. Support plates are attached to the first and second ends of the impeller assembly to provide sufficient mechanical strength during operational use. Each of the disks are interconnected by means of spacers and connecting rods attached to the interior perimeter of each disk and supporting plate. The connecting rods in turn are attached to a central hub. Connected to the central hub assembly is a driving means for rotating the central hub and impeller assembly, such as a motor or some similar mechanism.

The design of the present invention has significant advantages over the prior art. The multi-disk impeller assembly possesses significantly more surface area in comparison to single rotor designs. The increased surface area in combination with viscous drag operation creates a vastly superior design. Additionally, elimination of the central shaft and creation of a central cavity within the impeller assembly contributes to efficiency. The central shaft of conventional designs impedes the natural flow of fluid through the impeller system and also contributes to turbulence and loss of energy transfer by generating heat and vibration. By employing a central hub design, a central cavity of the impeller system is created, which permits fluid to flow unobstructed through the impeller assembly, thereby reducing unnecessary friction and turbulence.

Operationally, the driven impeller assembly works in conjunction with the interior surface of the housing to create a net negative pressure which draws the fluid medium through an inlet. The pump possesses a means for rotating the impeller assembly so that the plurality of disks are rotationally driven through the fluid medium, which displaces and accelerates the fluid through viscous drag to impart tangential and centrifugal forces to the fluid with continuously increasing velocity along a spiral path, causing the fluid to be discharged from an outlet. The principle of operation is based on the inherent physical properties of adhesion and viscosity of the fluid medium, which when propelled, allows the fluid to adjust to natural streaming patterns and to adjust its velocity and direction without the excessive shearing and turbulence associated with traditional vane-type rotors or impellers.

According to the present invention, as the disks of the impeller assembly are rotated and thereby driven through the fluid medium, the fluid layer in immediate contact with the disks is also rotated due to the strong adhesion forces between fluid and disk. The fluid in that layer is driven radially outward by the combined force of the adhesion or frictional interaction and the centrifugal force caused by the rotation thereof. The fluid adjacent to the fluid in immediate contact with the disk is also moved radially outward, but with an incremental decrease in energy due to the shearing stresses caused by the movement of the fluid in the fluid layer in contact with the disc. The incremental loss of energy imparted to the fluid progresses outwardly away from the surface area of the disc through the fluid resulting in less movement imparted to the fluid medium. Consequently, adjusting the spacing between adjacent discs such that this loss of movement is minimized enhances the flow rate and overall efficiency of the invention. In general, the spacing of the disks should be such that the entire mass of fluid is accelerated to a nearly uniform velocity, essentially equivalent to the periphery of the disks, and thereby generating sufficient pressure by the combined centrifugal and tangential forces imparted to the fluid to effectively and efficiently drive the fluid.

As can readily be appreciated, the flow rate is in proportion to the dimensions and rotational speed of the disks. As the surface area of the disks is increased by increasing the viscous drag surface area, so too is the amount of fluid in intimate contact with the disks, and therefore the greater the amount of fluid being driven, increasing the flow rate. As the number of disks are increased, the overall viscous drag surface area also increases, which also results in an increase in the flow rate. In addition, as the rotational speed of the impeller assembly is increased, the greater the tangential and centripetal forces being applied to the fluid, which will naturally increase the flow rate of the fluid.

The dimensions of the pump, the surface area and spacing of the disks contained within the impeller assembly will be determined by the conditions and requirements of individual applications. The efficiency of the pump, or other device employing the inventive impeller, is considerably improved over conventional mechanisms. The Turbopump requires approximately half the energy to drive the system, as compared to a conventional pump, and is approximately 25% smaller. The Turbopump has wide applications including air pumps, air circulators, circulating pumps for engines to transfer all types of fluids, pool and fountain circulating pumps, propulsion jets for baths and spas, air humidifiers, well and sump pumps and vacuum pumps. Also, because the Turbopump generates little heat during operation with consequential heating of the fluid medium, it is well suited for displacing low temperature liquids, such as liquefied gases. The Turbopump does not utilize paddles or vanes that collide with the fluid medium and therefore may be used to displace temperature and turbulence sensitive fluids, such as food products and biological fluids. The several embodiments presented herein all employ the inventive impeller assembly, or a modified version, to perform a wide variety of tasks.

In accordance with another aspect of the present invention, a Marine Jet Pump is provided. As with the Turbopump, the Marine Jet Pump utilizes an impeller assembly and employs the same principles of operation. As the impeller assembly is rotationally driven through the fluid medium causing the fluid to accelerate, the resultant negative pressure within the housing draws water from the external environment through a specialized conduit and is eventually discharged through an exhaust port to supply the propulsive force. The exhausted fluid is preferably attached to a standard marine directional nozzle to direct the fluid stream. The present invention eliminates the use of the standard multi-blade or vane impeller systems, resulting in less turbulence and loss of energy through the generation of heat and vibration.

According to yet another aspect of the present invention, a Hydroelectric Turbine is provided. This embodiment of the present invention also employs a similar impeller assembly but, rather than applying power to the impeller assembly for the displacement of fluids, the Hydroelectric Turbine provides power through the impeller assembly via propelled fluids. The same fundamental principles of fluid dynamics and transfer of energy apply, but in reverse. The kinetic energy of the fluid is transferred to the impeller assembly to provide rotational movement to the shaft, which is harnessed in any number of ways. The sub-components of the impeller assembly for this embodiment have several modifications to accommodate the method of operation. These modifications are described below.

According to yet another aspect of the present invention, a Fluid Turbine is provided. Similar to the Hydroelectric Turbine, the kinetic energy of the fluid is transferred to the impeller assembly to provide rotational movement to the shaft, which is harnessed in any number of ways. The same fundamental principles of fluid dynamics and transfer of energy apply as previously described. The sub-components of the impeller assembly for this embodiment have several modifications to accommodate the method of operation. These modifications as well as a detailed description of the embodiment are described below in the detailed description of the preferred embodiments.

According to another aspect of the present invention, a Turbine Transmission is provided. This embodiment comprises a number of subsystems, including a turbine section, a pump section, a sump assembly and a high pressure line interconnecting the pump and turbine sections. The subsystems are combined to form a closed system through which a fluid medium flows. This embodiment is particularly useful for driving items with a soft engagement requirement, such as motion sensitive machinery, marine use and most any other application requiring especially smooth, quiet and efficient transfer of power. The Turbine Transmission is especially adaptable to close quarters installation requirements and offers significantly lower noise and vibration levels during operation. Many of the features of the sub-components of the Turbine Transmission, as well as principles of operation, are described in the detailed description of the Turbopump and the Fluid Turbine. Additional modifications and features will be described in detail below.

DETAILED DESCRIPTION OF THE INVENTION

Turbopump

Referring to FIGS. 1A–E, a Turbopump and its various components are illustrated. The inventive impeller assembly described in the context of the Turbopump is also utilized in other embodiments described herein. Although there may be modifications to the impeller assemblies used in the other embodiments, many of the same general designs, features, sub-components and qualifications described below apply to these modified versions. As a result, the detailed description of the other embodiments will incorporate by reference much of the impeller assembly disclosure.

Figure 1A:
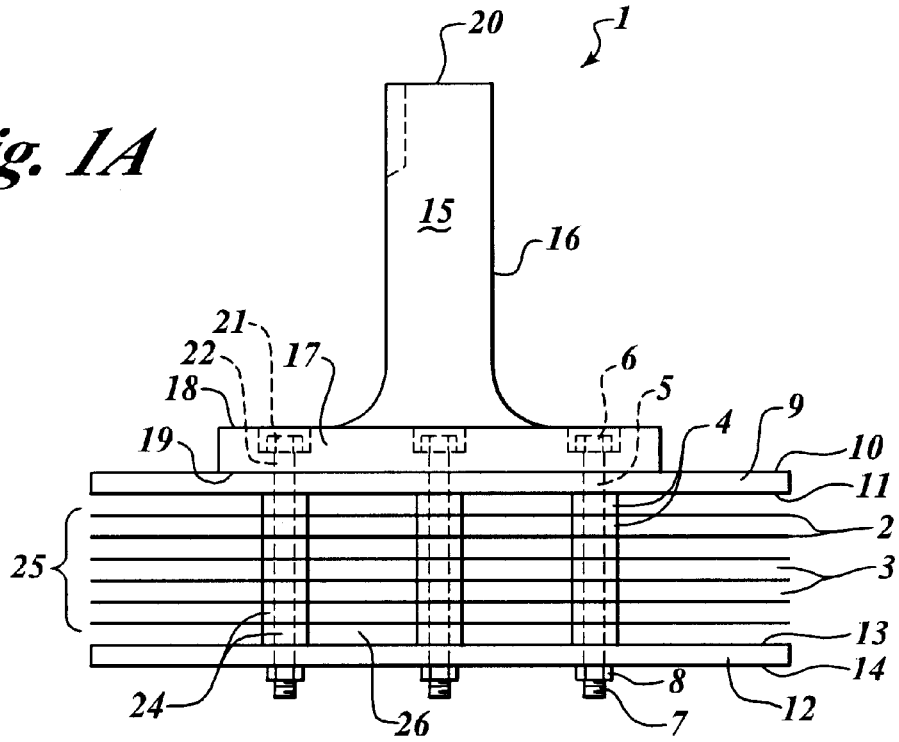
FIG. 1A illustrates a side view of the impeller assembly. For the sake of clarity, only a limited number of discs with wide intervening spaces are illustrated.
Figure 1B:
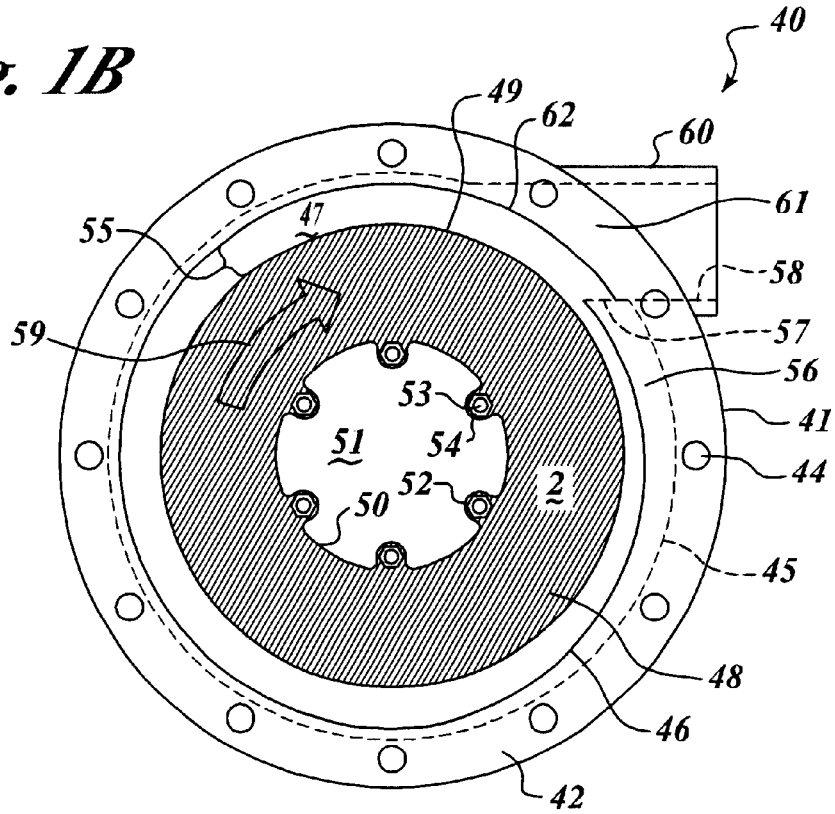
FIG. 1B illustrates the impeller assembly within the Turbopump housing, with the cover removed exposing the inlet-side backing plate.
Figure 1C:
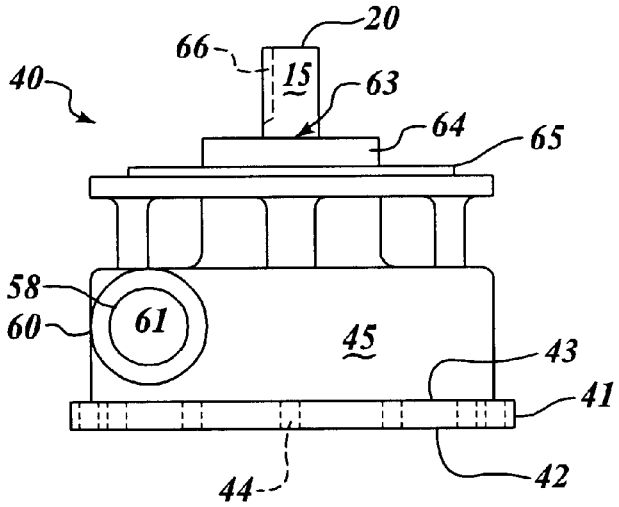
FIG. 1C depicts a side perspective of the Turbopump housing.

The impeller assembly 1 of the Turbopump, illustrated in FIG. 1A, comprises a plurality of viscous drag disks 2 arranged parallel to one another with distinct spaces 3 located between each disk. A top perspective of a representative disk is shown in FIG. 1B. The disks 2 are flat with a central aperture 51, which defines the inside perimeter 50 of the disk. The face 48 of the disk 2 forms the viscous drag surface area and defines the outer perimeter 49. The viscous drag surface area of the disks is essentially flat and devoid of any purposefully raised protrusions, engraved texturing, grooves and/or vanes. The surface area need not be completely devoid of any texture, and in certain applications may possess a roughened surface to provide additional friction for displacing fluid, so long as the roughened surface does not create disruptive turbulence in the fluid medium.

Along the inner perimeter 50 of the disks are a series of support islets 52 protruding into the central aperture 51. Each support islet contains a central aperture 53 which has been undercut 54. The number of support islets varies depending on the specific application. As described below, the support islets serve as a means to interconnect the disks to form the impeller assembly. A preferred number of support islets is 3 to 6, and in the preferred embodiment described herein, 6 are shown.

The disks may be composed of any suitable material possessing sufficient mechanical strength. The disks may, for example, be composed of metal, metal alloys, ceramics or plastics, and should be non-reactive with the fluid being displaced. Optionally, the material may be composed of a high-friction material to provide additional surface friction for displacing fluid. The dimensions of the disk, such as overall circumference, central aperture diameter and disk width, are variable and determined by the particular use. The size of the housing and the desired flow rate of a particular fluid also influence the size and number of disks in the impeller assembly. It is desirable that the disks of the impeller assembly be as thin as the specific application will allow to minimize turbulence. Only the viscous drag surface areas of the disks significantly affect the flow of fluid. The thickness of the disks is required for maintaining structural integrity under operating pressures. Therefore, it is preferable that the disks have a thickness capable of maintaining sufficient mechanical strength against stresses, pressures and centrifugal forces generated within the pump, yet as thin as conditions allow to reduce unnecessary turbulence. The materials and dimensions of the disks is largely dependent on the specific application involved, in particular the viscosity of the fluid, the desired flow rate and the resultant operating pressures. In certain applications, particularly small applications, the entire impeller assembly may be made of plastics or other material that is formed by injection molding, or a comparable method, to form an integrated piece rather than the individual components described below. Alternatively, the impeller assembly may be formed of die cast metal or powdered metal assemblies for applications requiring greater mechanical strength.

The inter-disk spaces between the disks is maintained by a series of spacers 4, which, together with the disks, create a stacked array of alternating disks and spacers 25. The spacers possess a central aperture complementary with the aperture of the support islets of the disks. The spacers may be of any suitable conformation that does not create undue turbulence in the fluid medium, and composed of any suitable material compatible with other components of the Turbopump and the fluid being displaced. Alternatively the spacers may be integrated into the disks rather than as distinct separate components, such as, but not limited to, a raised section at the islets of the inner rim of the disks, which is connected to another disk, thereby creating a space between the disks. The height of the spacers is an important variable in the design of the impeller system and is dependent on the specific application. For example, the inter-disk spacing may be from 1/16 to 1 inch and preferably from 1/8 to 1/2 inch. In general, the spacing of the disks should be such that the entire mass of fluid is accelerated to a nearly uniform velocity, essentially equivalent to the periphery of the disks, and thereby generating sufficient pressure by the combined centrifugal and tangential forces imparted to the fluid to effectively and efficiently drive the fluid. The greater the height of the spacer, the greater the inter-disk space, which has a direct effect on the negative pressure generated within the pump. In addition, the number of disks in the impeller assembly may be varied depending upon the use. In a preferred embodiment of the present invention, the impeller assembly comprises between 4 to 40 disks. In low pressure/high volume applications in which the fluid medium is air, the inter-disk spacing may larger than that required for displacing liquids, for example, but not limited to, 1/16 to about 1/2 inch. Furthermore, displacement of liquid gases may require inter-disk spacing on the low end of the range provided, or if necessary, beyond those ranges for optimal performance.

The impeller assembly also possesses a central hub 15. The central hub serves to transfer rotational power applied to the receiving end 20 of the shaft section 16 to the stacked array of disks 25. The central hub possesses a flange section 17 distal to the shaft section, having an inside 19 and outside 18 face. The inside face 19 of the flange section 17 is in immediate contact with an outside face 10 of a first reinforcing backing plate 9. The present invention also encompasses designs wherein the central hub and first reinforcing backing plate are one integral work-piece, whether cast or machined. The inside face 11 of the first reinforcing backing plate is in immediate contact with a series of spacers 4. A second reinforcing backing plate 12, is located distal to the stacked array of spacers and disks. In a preferred embodiment, the reinforcing backing plates have the same design and dimensions as the viscous drag disks 2 shown in FIG. 1B.

As evidenced in the illustration, the reinforcing backing plates of the impeller system are considerably thicker than the disks in order to provide additional mechanical support to the stacked array of disks to counteract the negative pressure created in the inter-disk spaces, particularly at the outside periphery of the disks. The reinforcing backing plates serve as a support means for the disks by providing a solid and relatively inflexible surface for the disks to pull against, thereby reducing the tendency of the disks to flex and deflect inwardly in the inter-disk spaces. The thickness of the reinforcing backing plates is largely dependent on the diameter, and therefore the surface area, of the disks. As a general principle, the reinforcing backing plates may be four times as thick as the disks, but this relationship may vary dependent on the particular application.

The central hub 15, the first reinforcing backing plate 9, the stacked array of spacers and disks 25 and the second reinforcing backing plate 12 of the impeller assembly are interconnected by a plurality of connecting rods 5. The distal end of the connecting rods 7 pass through the apertures 22 of the flange section 17 of the central hub through the complementary apertures of the first reinforcing backing plate 9, spacers, disks and second reinforcing backing plate 12. The distal end of the connecting rods are secured against the outside face of the second reinforcing backing plate by any suitable retaining means 8. The proximal end of the connecting rods 6 has a securing means that is seated in the countersunk opening 21 of the apertures 22 of the flange section of the central hub. The retaining means 8, such as conventional nut threaded onto the distal end of the connecting rod, or any other suitable retaining means, is secured in such a manner as to draw the second reinforcing backing plate towards the proximal end of the connecting rod, thereby drawing all components into tight association. Although the preferred embodiment described herein shows a through-bolt arrangement for connecting the sub-components of the impeller assembly, the present invention also anticipates the use of other similar connecting means, such as a stud-bolt arrangement for the connecting rods, having a threaded proximal and distal end, and a welded-stud arrangement, where the connecting rods are secured to the central hub and the second reinforcing backing plate by welded connections.

Alignment of the central apertures of the two reinforcing backing plates and the stacked array of disks form a central cavity 26 within the impeller assembly. Supporting the disks and backing plates at the inside perimeter eliminates the central shaft employed in previous designs, as well as the spokes used to attach the disks to the central shaft, thereby eliminating the turbulence created by the central shaft and associated spokes of the disks. The central cavity permits the fluid to flow in a more natural line into the impeller assembly without the churning effect of the shaft and spokes.

FIG. 1B illustrates the Turbopump with the inlet cover and second reinforcing backing plate removed to reveal the most distal disk of the stacked array 25. The housing 40 of the Turbopump may be of any conventional design that provides a complimentary surface for the impeller assembly. The housing comprises an outer 45 and inner wall 46 of the housing body, forming an interior chamber 47 of sufficient volume to accommodate the impeller assembly, yet maintain a gap 55 between the impeller assembly and the inside wall of the housing. The gap provides a complementary surface for the impeller system to draw against, to allow movement of the fluid within the housing and to create a zone of high pressure. The volume area defined by the gap 55 affects flow rate and operating pressure. In certain embodiments, the total gap volume should be between 10 and 20% greater than the inlet volume area, but may be smaller, depending on the application. Additional factors to be considered in determining the gap volume are output pressure, and sheer mass, viscosity and particulate size of the fluid medium The Turbopump housing possesses a housing flange 41 with a series of holes 44 extending from the faceplate 42 of the flange through to the underside 43 of the flange. The inner wall of the housing forms a fluid catch 56 by an inwardly angling extension of the wall to create a shoulder 57, which is continuous with the inner wall 58 of an outlet port 60 having a central aperture 61. The inner wall of the housing has an opening 62 to permit fluid to flow through the central aperture 61 of the outlet port 60.

The impeller assembly is oriented within the internal chamber 47 of the housing by threading the receiving end 20 of the central hub 15 through a centrally oriented opening 63 of the bearing/seal assembly 64 such that the shaft section 16 of the central hub is securely held and supported by the bearing/seal assembly. The bearing/seal assembly is integrated into the rear plate 65 of the Turbopump housing by conventional means. One possible configuration has the bearing/seal as a cartridge unit (although the bearing and seals may be separate units) that is press-fitted on to the shaft and then pressed into the housing. The bearing/seal assembly may be of any conventional configuration that will provide sufficient support for the impeller assembly, permit as friction-free radial movement of the shaft as possible and prevent any leaking of fluid from the internal chamber.

The Turbopump is driven by any drive system capable of imparting rotational movement to the shaft 16 of the central hub, thereby imparting rotational movement to the entire impeller assembly within the internal cavity of the Turbopump housing. The receiving end 20 of the central hub may be of various configurations, such as keyed, flat, splined, and the like, to allow association with various motor systems. A preferred embodiment depicts a standard shaft configuration, which has been keyed with a receiving notch 66 formed at the receiving end of the shaft 16 for receiving a complementary retaining device associated with the drive system. Other examples include flex-joints, universal joints, flex-shafts, pulley systems, chain-drive, belt-drive, cog-belt-drive systems, direct-couple systems, and the like. Any drive system, such as a motor or comparable device, that directly or indirectly imparts radial movement to the impeller assembly through the shaft may be employed with the present invention. Suitable drive systems include motors of all types, in particular electrical, internal combustion, solar-driven, wind-driven, and the like.

Figure 1D:
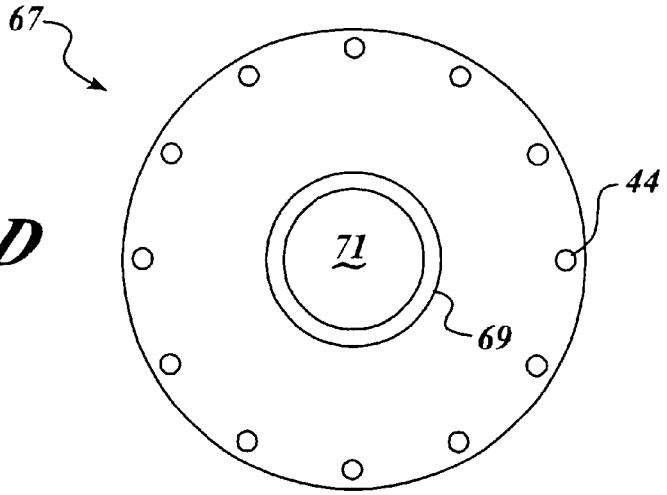
FIG. 1D shows a top view of the Turbopump cover with inlet port.
Figure 1E:
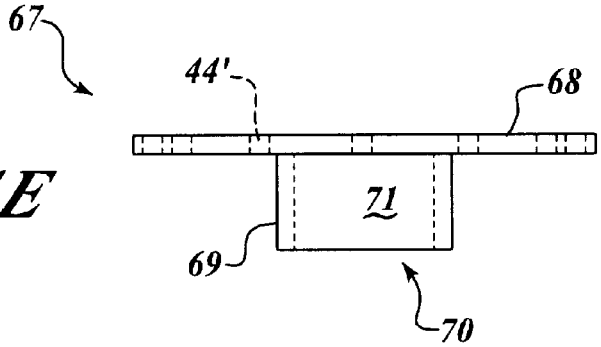
FIG. 1E illustrates a side perspective of the Turbopump cover.

The inlet port cover 67, as shown in FIGS. 1D and 1E has a circumference comparable to the circumference of the housing flange, and has a series of apertures 44' that are spatially oriented to be complementary to the apertures 44 in the housing flange 41. The inlet port cover is attached to the Turbopump housing by securing the inside face 68 of the inlet port cover to the face plate 42 of the housing flange and fixedly attached by securing means through the complementary apertures 44, 44'. In the context of the present invention, the term "fixedly" does not necessarily mean a permanent, non-detachable attachment or connection, but is meant to describe a variety of connections well known in the art that form tight, immovable junctions between components. The face plate of the inlet port cover defines the ceiling of the internal chamber 47 of the Turbopump housing. Fluid is drawn into the opening 70 of inlet port 69 and through the inlet port conduit 71 to the internal chamber 47 of the housing.

Operationally, the internal chamber of the Turbopump is primed with a fluid compatible to that being displaced to void the chamber of air. The drive system is activated to impart radial movement to the shaft 16 of the central hub 15, turning the stacked array of disks 25 through the fluid medium in the direction of the arrow 59. As the disks 2 of the impeller assembly are driven through the fluid medium, the fluid in immediate contact with the viscous drag face 48 of the disks is also rotated due to the strong adhesion forces between the fluid and disk. The fluid is subjected to two forces, one acting tangentially in the direction of rotation, and the other centrifugally in an outward radial direction. The combined effects of these forces propels the fluid with continuously increasing velocity in a spiral path. The fluid increases in velocity as it moves through the narrow inter-disk spaces 3 causing zones of negative pressure at the inter-disk spaces. The continued movement of the accelerating fluid from the inside perimeter of the disks 50 to the outside perimeter of the disks 49 further draws fluid from the central cavity 26 of the impeller assembly, which is essentially continuous with the inlet port conduit 71 of the inlet port 69. The net negative pressure created within the internal chamber 47 of the Turbopump draws fluid from an outside source connected by any conventional means to the inlet port.

As fluid is accelerated through the inter-disk spaces to the outside perimeter of the disks, the continued momentum drives the fluid against the inner wall of the housing chamber creating a zone of higher pressure defined by the gap between the outside perimeter of the disks and the inner wall of the housing chamber 55. The fluid is driven from the zone of relative high pressure to a zone of ambient pressure defined by the outlet port 60 and any further connections to the system. The fluid within the system may circulate a number of times before being displaced through the outlet port. The fluid catch 56 of the inner wall serves to impel the flow of circulating fluid into the central aperture of the outlet port.

Marine Jet Pump

An additional embodiment of the present invention is illustrated in FIGS. 2A–D. The Marine Jet Pump employs essentially the same impeller assembly 1 as described for the Turbopump, and therefore attention should be drawn to FIGS. 1A and 1B and the corresponding written description for a detailed disclosure of the impeller assembly, associated components and systems, as well as principles of operation.

Figure 2A:
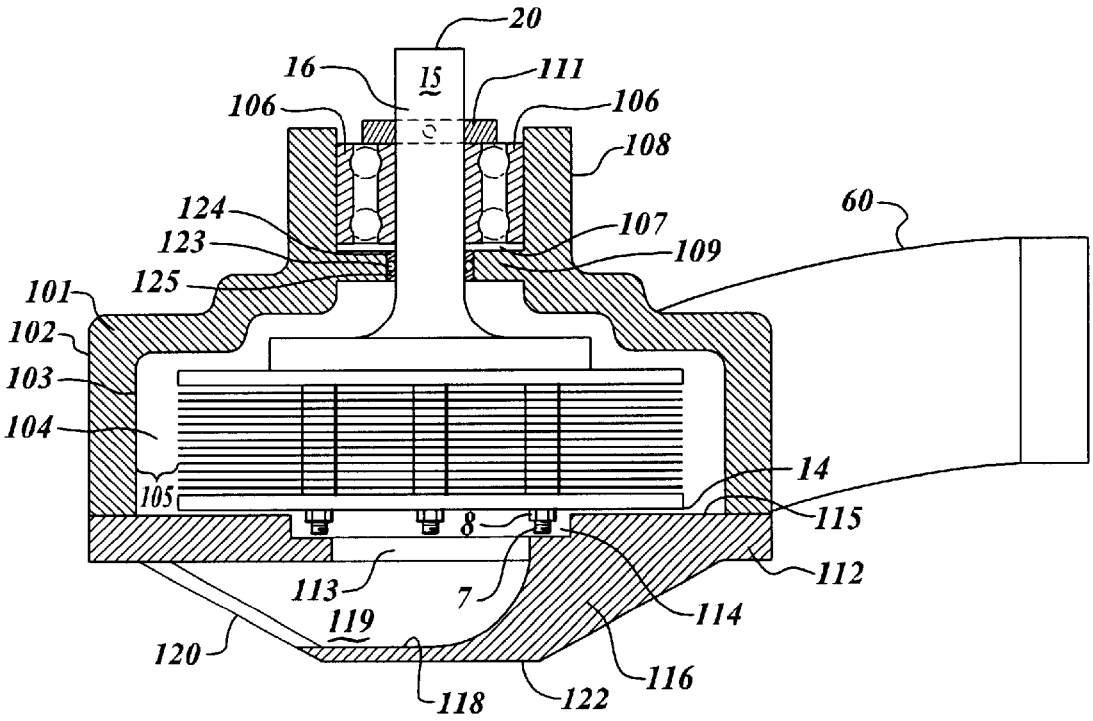
FIG. 2A shows a cross-sectional side perspective of the Marine Jet Pump.
Figure 2B:
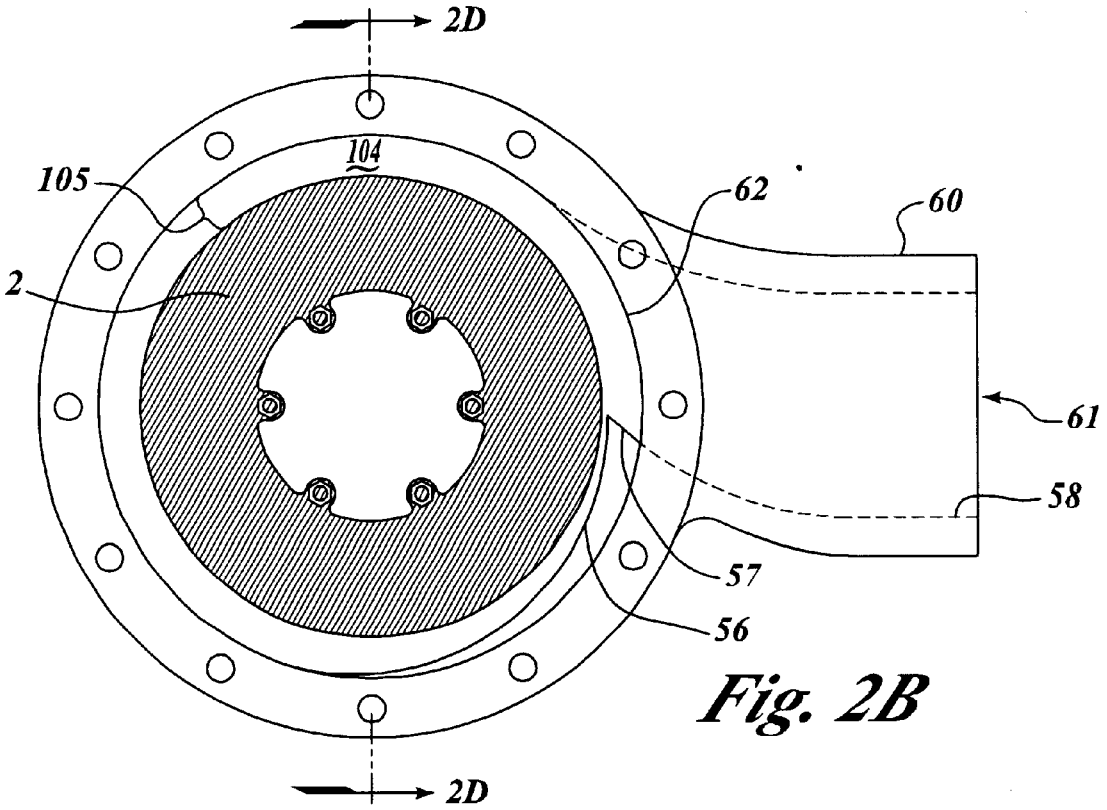
FIG. 2B shows an end-on view of the Marine Jet Pump with the bottom plate cover removed.
Figure 2C:
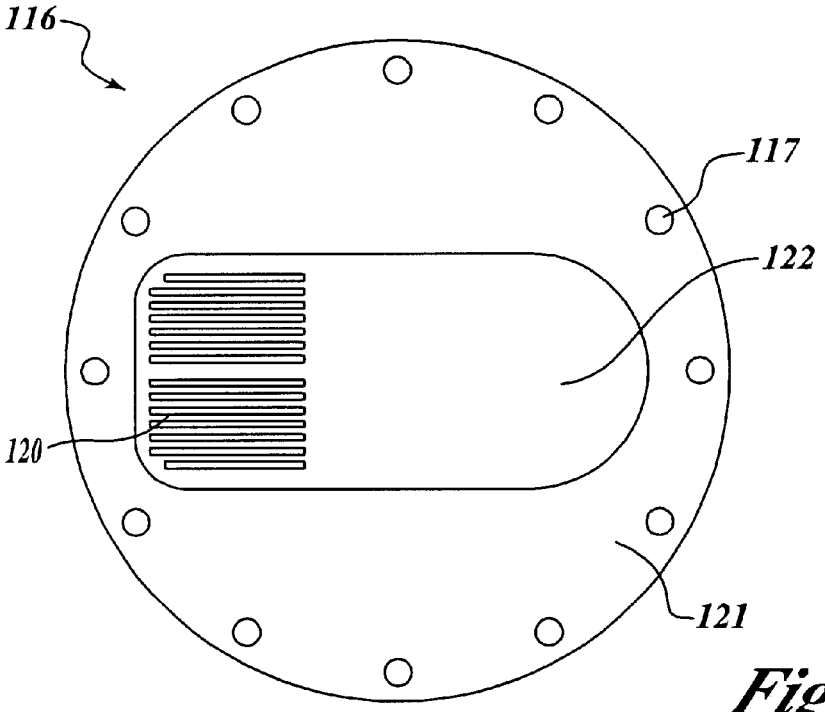
FIG. 2C illustrates the bottom cover plate from a top perspective.
Figure 2D:
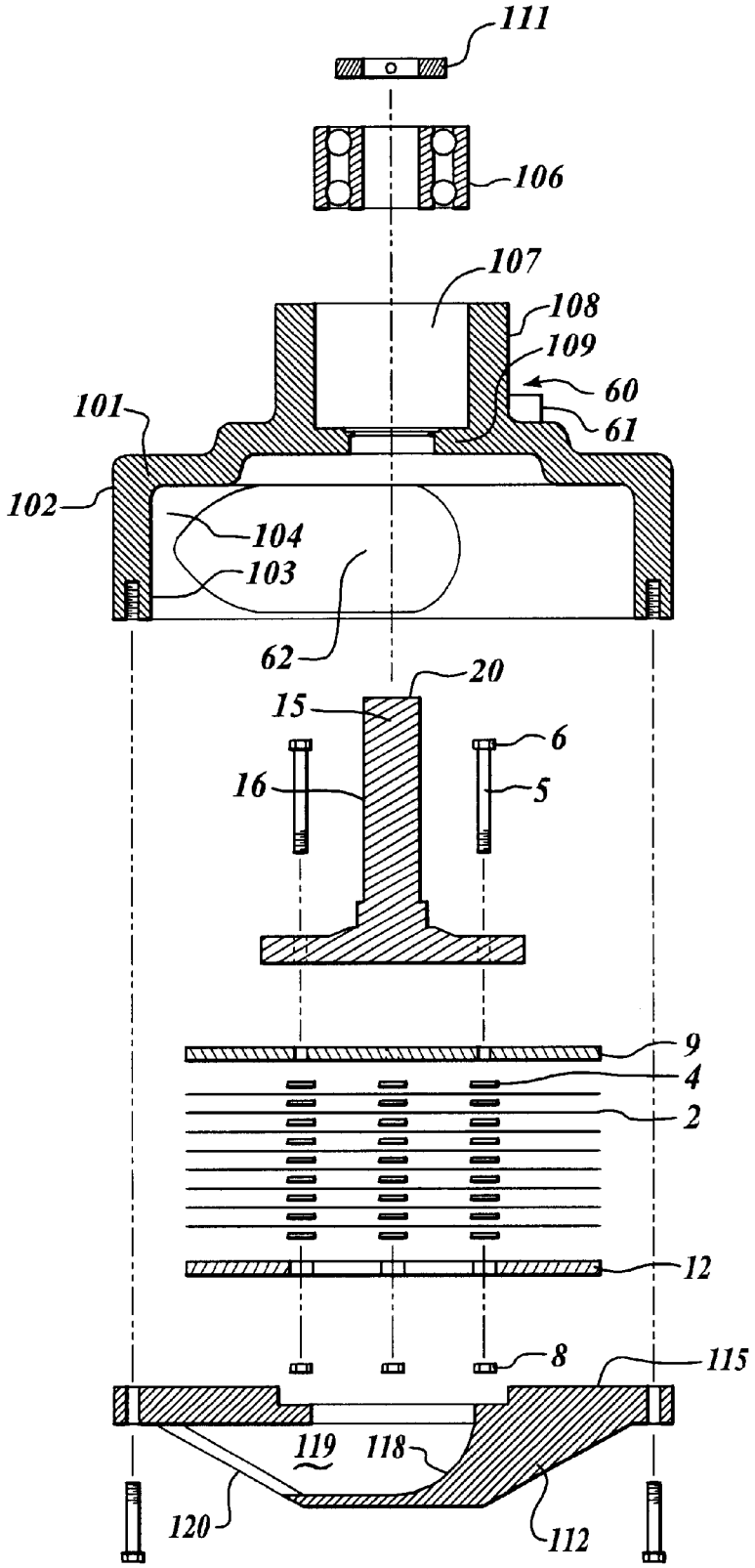
FIG. 2D is an exploded illustration of a cross-sectional side perspective of the Marine Jet Pump.
Figure 3A:
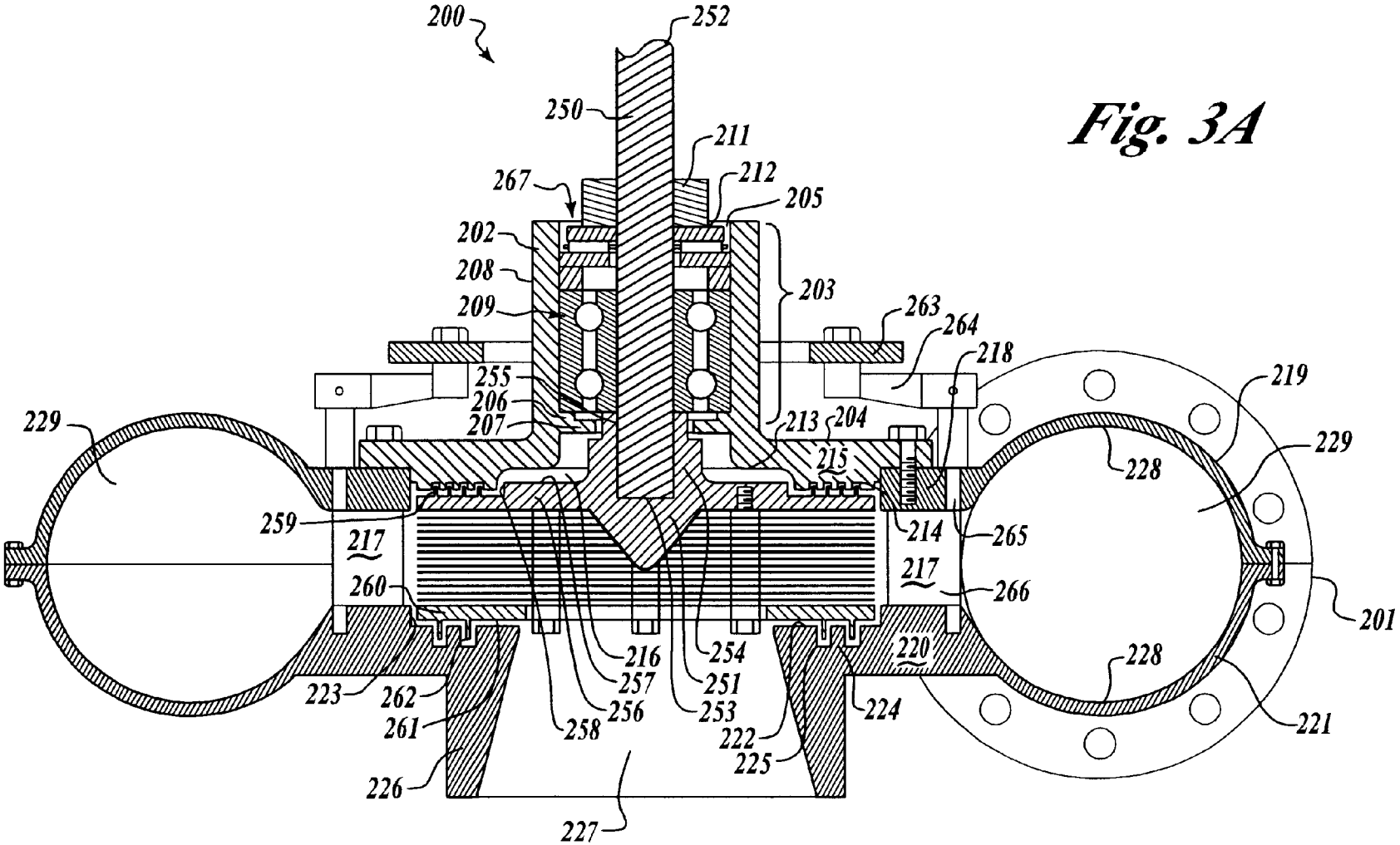
FIG. 3A depicts a cross-sectional side view of a hydroelectric turbine incorporating the impeller assembly.
Figure 3B:
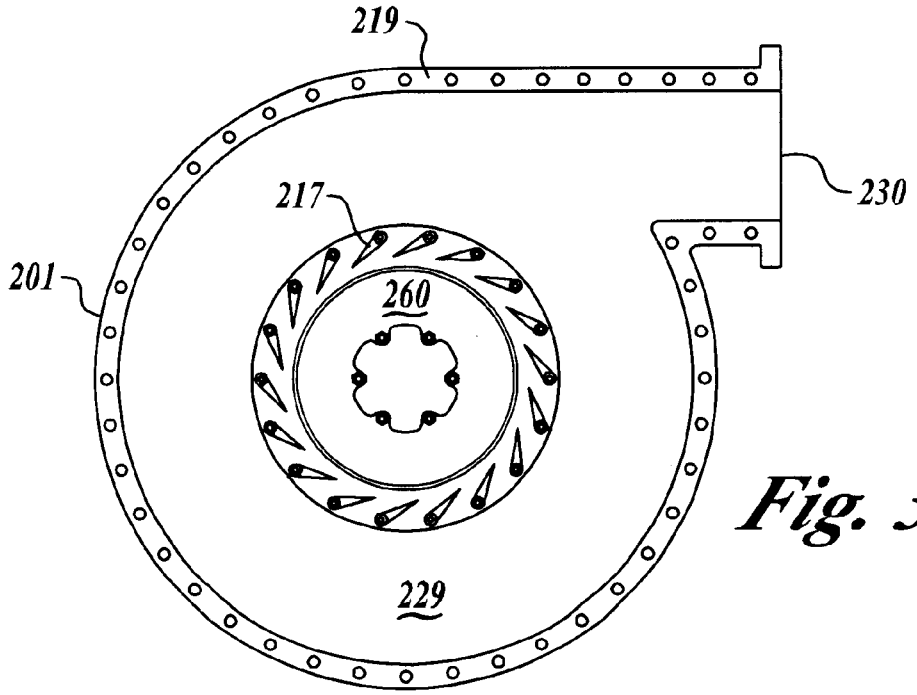
FIG. 3B shows a top view of the top half of the housing.
Figure 3C:
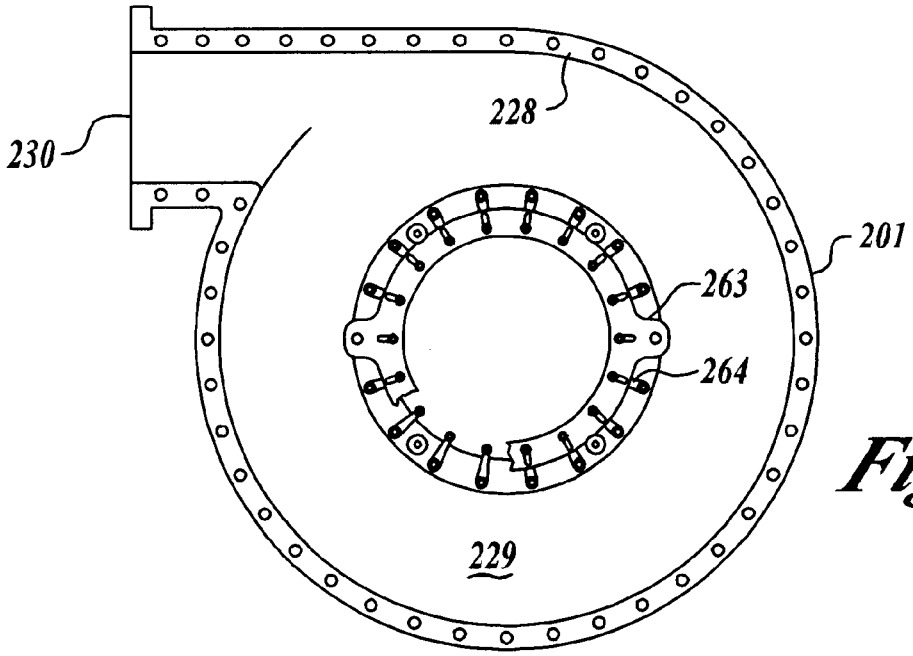
FIG. 3C illustrates a top perspective of the top half of the housing with the shifting ring connected to the wicket gates.
Figure 3D:
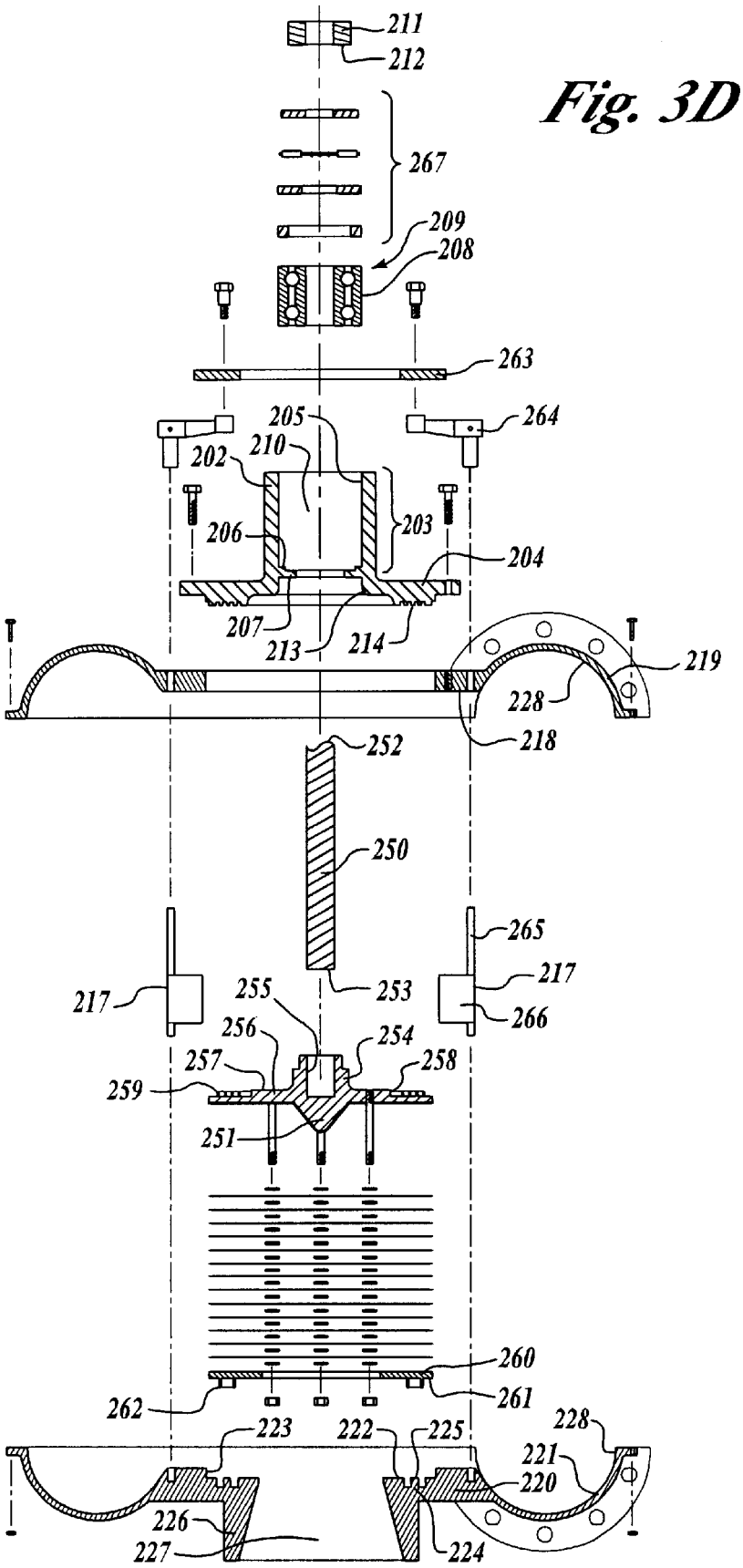
FIG. 3D is au exploded illustration of a cross-sectional side view of the hydroelectric turbine.

FIG. 2A is a cross-sectional side view illustrating the arrangement of the impeller assembly 1 within the jet pump housing 101. The jet pump housing may be made of any suitable material including cast and/or machined metals or metal alloys such as iron, steel, aluminum, titanium, and the like. The jet pump housing possesses an exterior 102 and interior wall 103, which forms an internal chamber 104 of sufficient volume to accommodate the impeller assembly 1 and maintain a gap 105 between the disks and backing plates of the impeller assembly. In certain applications, the gap 105 is between 1/16 and 1 inch, and typically around 1/4 inch, depending on size and amount of particulates in the fluid medium. The gap may extend beyond this range for optimal performance under certain conditions. The shaft section 16 of the central hub 15 in the impeller assembly is supported by a series of support bearing assemblies 106 housed within the cavity 107 formed by the support collar 108, which is an extension of the jet pump housing. The floor of the cavity 107 housing the support bearing assemblies is formed by a flange section 109 extending from the interior wall of the support collar. Extending from the flange section 109, is a lip 123, which provides a seat for a top seal 124 and a bottom seal 125. The bearing support assemblies are retained within the support collar cavity by a retaining ring 111, or comparable retaining device, fixedly associated with the shaft section of the impeller assembly, thereby providing structural support to the impeller assembly. As previously noted, the bearing/seal assembly may be of any appropriate configuration that provides sufficient support and permit as friction-free radial movement of the shaft as possible, as well as prevent any leakage from the internal chamber. The seals utilized in the system may be of various configurations and compositions, so long as they are non-reactive and wear-resistant. Suitable materials include rubber, urethane, polyurethane, silicone, other synthetic materials, and the like.

The floor of the internal chamber 104 is defined by a cover 116, having a bottom plate 112 with a central aperture 113. The diameter of the central aperture of the bottom plate is roughly equivalent to the diameter of the central aperture of the backing plates and disks. Integral with the bottom plate is a cowl section 122, having a grated section defining an inlet port 120. The interior surface 115 of the bottom plate is recessed 114 to accommodate the distal ends of the connecting rods 7 and the retaining means 8. This feature permits the bottom plate to be in close association with the interior surface 115 of the bottom plate and the outside face of the inlet-side backing plate 14, preferably in the range of 1/16 to 1 inch and more preferably in the range of 1/8 to 1/2 inch. The cover 116 (FIGS. 2A and 2C) is fixedly attached to the jet pump housing by any appropriate securing means, such as a bolt threaded through a plurality of apertures 117 formed in the flange section 121 of the cover to complementary threaded apertures on the bottom plate. The interior wall 118 of the cowl section 122 forms an interior conduit 119 continuous with the grated inlet port 120 to permit fluid to pass from the external environment into the internal chamber of the marine jet housing. The inlet port is grated to screen out undesirable material from entering the internal chamber of the jet pump.

The Marine Jet Pump employs the same principles of operation as the Turbopump. As with the Turbopump, various connections or associations between the drive system and the Marine Jet Pump, as well as various drive systems are envisioned. The Marine Jet Pump is partially submersed in a fluid medium and primed to remove air from the system. The drive system is activated to impart radial movement to the shaft 16 of the central hub 15, turning the stacked array of disks 25 through the fluid medium in the direction of the arrow 59. As the disks 2 of the impeller assembly are driven through the fluid medium, the fluid in immediate contact with the viscous drag face 48 of the disks is also rotated due to the strong adhesion forces between the fluid and disk. The continued movement of the accelerating fluid from the inside perimeter of the disks 50 to the outside perimeter of the disks 49 further draws fluid from the central cavity 26 of the impeller assembly. The net negative pressure created within the internal chamber 104 of the Marine Jet Pump continuously draws fluid through the grated inlet port 120 of the cover 116 through the interior conduit 118 and aperture of the bottom plate to the central cavity of the impeller assembly.

As fluid is accelerated through the interdisk spaces to the outside perimeter of the disks, the continued momentum drives the fluid against the inner wall of the housing chamber creating a zone of higher pressure defined by the gap between the outside perimeter of the disks and the inner wall of the housing chamber 55. The fluid within the system may circulate a number of times before being displaced through the outlet port. The fluid catch 56 of the inner wall serves to impel the flow of circulating fluid into the central aperture of the outlet port. The fluid is driven from the zone of relative high pressure 55, as previously described above, to a zone of ambient pressure defined by the outlet port 60 and any further connections to the system. The exhausted fluid is preferably attached to a standard marine directional nozzle to direct the fluid stream into the surrounding water supplying the propulsive force for the marine craft. Alternatively, the present invention may also be fitted with any suitable power head to optimize performance.

The present invention also envisions various modifications to the design presented herein, including one or more inlet and/or outlet ports; one or more inlet or outlet ports located at different locations on the jet pump, whether on the front, sides, or bottom of the jet pump housing. Furthermore, the present invention may be mounted to the hull of the vessel in any suitable location at any appropriate angle for optimal performance.

Hydroelectric Turbine

A Hydroelectric Turbine 200 employing a modified version of the inventive impeller assembly 1 is illustrated in FIGS. 3A–D. The turbine operates under the same general principles of operation as previously described for the pump, but in reverse. Many of the design features of the impeller assembly described above are equally applicable to the turbine embodiments and are therefore incorporated herein, where appropriate. There are distinct differences in the method of operation between the pump and turbine, although the same basic design of the impeller assembly is utilized. For example, in the pump, the centrifugal forces and the tangential forces imparted to the fluid medium are additive resulting in greater head pressure, which facilitates the expulsion of the fluid medium from the exhaust port. In contrast, the centrifugal forces in the turbine are in opposition to the tangential or dynamic forces of the fluid medium, thereby reducing the effective head pressure and velocity of radial flow to the center of the impeller assembly. As a result, the efficiency of the turbine generally benefits from having a greater number of disks and smaller inter-disk spaces in the impeller assembly, as compared to the pump.

The Hydroelectric Turbine comprises an impeller assembly contained within a housing comprising several subcomponents. The housing may be machined, cast, or a combination of both, and made of any suitable material well known in the art, and in particular, the materials previously mentioned. Integral with the housing is a penstock 201 which surrounds the housing and impeller assembly. The housing is comprised of a top cover 202 having a support collar section 203 and a flange section 204. The interior of the upper portion of the support collar section of the top cover forms the bearing housing 210 for supporting the shaft of the impeller assembly. One or more bearing assemblies 209 are restrictively retained within the bearing housing 210 by the interior face 205 of the upper portion of the support collar section, which is in immediate contact with the exterior face 208 of the bearing assembly. Extending inwardly from the interior face of the support collar section is a first rim 206, forming the seat of the bearing housing. Integral with the first rim and the interior face of the support collar is a second rim 207, which serves as a support for the seal assemblies. Alternative designs may employ bushings and bushing-bearing combinations, as well as other comparable means well known in the art. The shaft section 250 of the impeller assembly is supported by the compressive forces exerted by the bearing assembly and support collar of the housing. This particular arrangement permits low friction radial movement of the impeller assembly while restricting lateral and horizontal movement The present invention also envisions employing any other conventional apparatus well known in the art to achieve the same objectives. The upper section of the shaft, distal from the receiving end 252 of the shaft, possesses an outwardly extending ring section 211 whose bottom shoulder 212 is in tight association with the seal assembly 267, which is in tight association with the top of the bearing assembly, thereby holding the bearing assembly against the seat 207 of the bearing housing 210. The present invention also envisions other retaining means for holding the bearing assemblies other than the ring or collar extending from the body of the impeller shaft, such as a retaining or compression ring fixedly associated with the shaft.

The interior surface 213 of the flange section 204 of the top cover defines the top section of the upper labyrinth seal 215, which has a first series of grooves 214 formed therein. The interior surface of the top cover also forms the ceiling of an internal chamber 216 within the turbine housing which houses the impeller assembly. The side wall of the internal chamber is defined by a plurality of wicket gates 217 and the structural rim 218 of the upper body 219 of the penstock 201. The wicket gates are pivotably connected to the housing, to permit movement around a central axis. The floor of the internal chamber is defined by the interior surface 222 of the structural rim 220 of the lower body 221 of the penstock. The interior surface of the structural rim of the lower body is recessed 223 to accommodate the impeller assembly. The interior surface of the recessed section 223 has a second series of grooves 225 formed therein to define the bottom section of the lower labyrinth seal 224. Other configurations of labyrinth seals or other seal means of restricting the intrusion of fluid well known in the art are envisioned by the present invention. For example, there may be a greater or fewer number of ridges and grooves, or there may be one or more ridges per groove depending on the specific requirements of the particular application. Extending from the structural rim 220 of the lower body of the penstock is a conduit section 226, the interior of which forms the exhaust port 227.

The impeller assembly previously described has several modifications to the sub-components to adapt it for use in a Hydroelectric Turbine. In particular, the central hub comprises two components, the straight shaft section 250 fixedly attached to a hub-plate 251. The hub-plate has a support collar section 254 having an interior wall 255 forming a cavity to receive the connecting end 253 of the shaft. The shaft section may be fixedly joined to the hub-plate by any conventional means to form a tight association, including threaded, welded, keyed, splined, bolted, press-fitted and/or compression connections, and the like. Alternatively, the shaft and the hub-plate may be cast and/or machined as one integral piece. Extending from the collar section of the hub-plate, is the top reinforcing backing plate section 256 with a top surface 257 that is recessed to form the bottom section 258 of the upper labyrinth seal. The bottom section of the upper labyrinth seal has a first plurality of raised ridges 259 that fit into the complementary first set of grooves 214 of the top section of the upper labyrinth seals 215. This configuration, as well as similar configurations, and other seal means well known in the art, serve to restrict the movement of fluid beyond the seal, thereby keeping more fluid flowing over the disks, thereby enhancing the efficiency of the present invention. The modified impeller assembly of the Hydroelectric Turbine shares the same configuration of disks, spacers, connecting rods, etc as previously described. The aforementioned components for the Hydroelectric Turbine undergo may require different dimensions and stronger materials to accommodate the greater mechanical stress of the system, but generally, the disks and other components may be of any suitable dimensions. For example, but not limited to, the disks may be in the range of 2 to 20 mm thick and 20 to 2,500 mm in diameter. In general, the hub-plate is four times thicker than the main disks, although this relationship may vary to accommodate particular applications. Compared to the pump impeller design, the turbine design is more generally more efficient with relatively more disks placed closer together. For example, a typical turbine may have 4 or greater than 40 disks per impeller assembly with an inter-disk spacing of preferably 1/16 to 1 inch and more preferably in the range of 1/8 to 1/2 inch, or as required by the particular demands of the specific application. The inlet side backing plate 12 described in the previous embodiments has been replaced with a bottom reinforcing/labyrinth seal plate 260. The lower face 261 of the bottom reinforcing/labyrinth seal plate has a second plurality of raised ridges that are fit into the complementary grooves 225 of the bottom section of the lower labyrinth seal, forming the lower labyrinth seal.

The penstock 201 portion of the housing is formed by fixedly joining, by any conventional means, the upper body 219 and the lower body 221 to define a chamber encircling the impeller assembly and associated structural components. The upper and lower body of the penstock each have an interior surface 228 continuous with the other to form an interior conduit 229. The interior surface of the penstock 228 extends outwardly to create a fluid inlet port 230, which may be connected to any additional components for bringing fluid to the inlet port.

In operation, fluid having sufficient velocity enters the fluid inlet port 230 and fills the interior conduit 229 of the penstock 201, creating a zone of high pressure. As the pressure of the fluid increases within the fluid conduit, the fluid is forced through the wicket gates 217 and into the internal chamber of the housing 216. The wicket gates are operated by a controlling mechanism, such as a shifting ring 263, which serves as a means of controlling the flow of the fluid into the internal chamber of the housing, and therefore the speed and output of the turbine. The shifting ring is connected to the vertical section 265 of the wicket gate by any connecting assembly 264 well known in the art. The rotational speed of the turbine may be regulated by controlling the volume of fluid flowing through the impeller assembly, as well as the angle at which the pressurized fluid contacts the impeller assembly. To control the volume of fluid, the wicket gates are regulated to adjust the volume of fluid entering the internal chamber of the housing. Regulation of the wicket gates is by means of a shifting ring, or any other conventional means, which may be controlled by a centrifugal governor. The centrifugal governor is connected to the shifting ring by conventional means and may be actuated by any suitable controlling mechanism, such as, but not limited to, mechanical and electrical devices, for example, a servomotor and servomechanism. The centrifugal governor is engaged as the turbine reaches a select rotational speed, which in turn rotates the shifting ring adjusting the wicket gates and thereby regulating the volume of fluid and consequently the rotational speed of the turbine. The present invention also envisions employing other conventional controlling mechanism well known in the art.

As the fluid passes into the internal chamber, the pressurized fluid encounters the impeller assembly. The tortuous path of the upper and lower labyrinth seals creates a physical obstacle to the fluid, causing the fluid to preferentially move across the disks of the impeller assembly. With reference to the previous description of the disks of the impeller assembly, the moving fluid initially contacts the outside perimeter of the disks 49 (refer to FIG. 1B), moves across the viscous drag face 48 of the disks to the inside perimeter 50, and through the central aperture 51 of the impeller assembly. The fluid continues to flow from regions of high to low pressure until eventually expelled from the exhaust port 227. As the fluid moves across the disks, energy is transferred to the impeller assembly through the friction of the fluid in immediate contact with the face of the disks in combination with the adhesive forces of the fluid, causing a continuously decreasing velocity in the fluid. The energy transferred to the disks from the moving fluid is predominantly in the form of tangential or dynamic forces imparted to the disks, which cause the entire impeller assembly to rotate around its central axis. The bearing assembly 209 supports the shaft of the impeller assembly and permits rotational movement of the shaft 250 with a minimum of non-rotational movement. The receiving end of the shaft 252 may be connected by any conventional means known in the art to any number of mechanical devices for utilizing or applying the rotational movement produced thereby.

Fluid Turbine

Figure 4A:
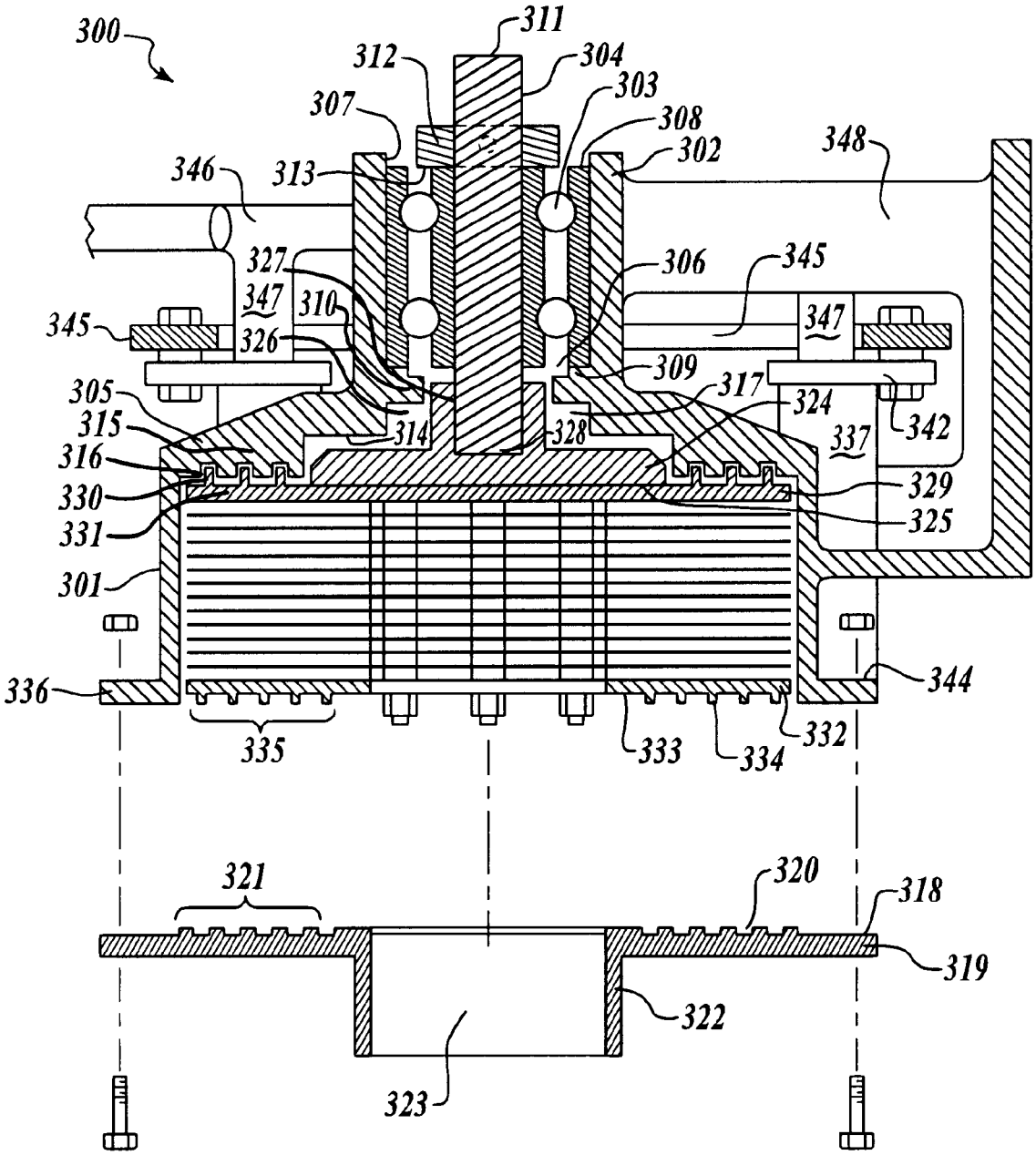
FIG. 4A illustrates a cross-sectional side view of the Fluid Turbine with the end cover unattached.
Figure 4B:
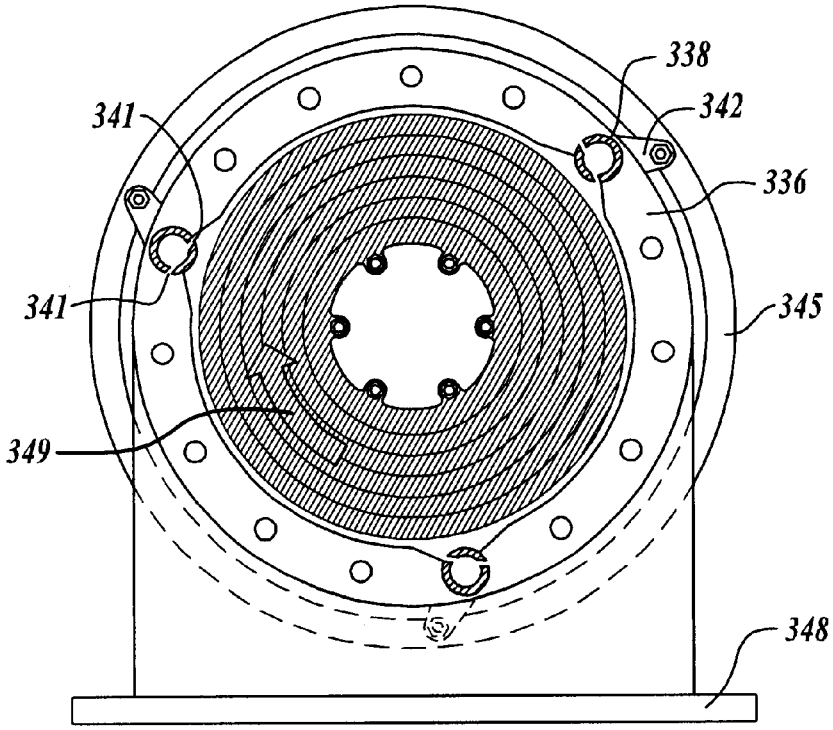
FIG. 4B shows a bottom perspective of the Fluid Turbine with the end cover removed to expose the cross-sectional view of the reversing nozzles. For simplicity, only the bottom reinforcing/labyrinth seal plate is shown in the internal chamber of the main housing.
Figure 4C:
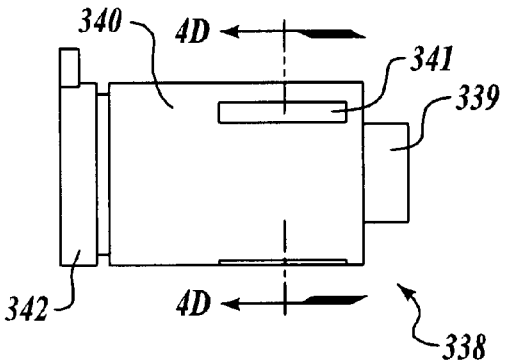
FIG. 4C illustrates a side view and a cross-sectional bottom view of a reversing nozzle.

A Fluid Turbine 300 employing a modified version of the inventive impeller assembly 1 is illustrated in FIGS. 4A–C. The Fluid Turbine comprises an impeller assembly contained within a main housing 301 comprising several subcomponents. The general design and principles of operation of the impeller assembly has been previously described and, where applicable, are incorporated into the description of this embodiment of the present invention. The main housing has a narrower support collar section 302 which houses the bearing assemblies 303 that support the shaft 304 of the impeller assembly.

The main housing has a bell-shaped section 305 continuous with the collar support section. A structural brace section 348 connects the two sections of the main housing described above. The interior of the upper portion of the support collar section of the top cover defines the bearing housing 306 for supporting the shaft of the impeller assembly. One or more bearing assemblies 303 are restrictively retained within the bearing housing 306 by the interior face 307 of the upper portion of the support collar section, which is in immediate contact with the exterior face 308 of the bearing assembly. Extending inwardly from the interior face of the support collar section is a first rim 309, forming the seat of the bearing housing. Integral with the first rim and the interior face of the support collar is a second rim 310, which serves as a seal support surface. The shaft section 304 of the impeller assembly is supported by the compressive forces exerted by the bearing assembly and support collar of the housing. This arrangement permits low friction radial movement of the impeller assembly while restricting lateral and horizontal movement. The upper section of the shaft, distal from the receiving end 311 of the shaft, possesses a retaining means, such as a retaining ring 312 whose bottom shoulder 313 is in tight association with the top of the bearing assembly, thereby holding the bearing assembly against the seat 309 of the bearing housing 306. The present invention also envisions other retaining means for holding the bearing assemblies other than the retaining ring, such as a compression ring fixedly associated with the shaft. The present invention may also employ any conventional retaining devices known in the art, including, but not limited to, a sir clip, locking bolt, snap ring, taper lock and press fit.

The interior surface 314 of the bell section 305 of the main housing forms the top section of the upper labyrinth seal 315, which has a first series of grooves 316 formed therein. The interior surface of the top cover also defines the ceiling and sides of an internal chamber 317 within the main housing which houses the impeller assembly. The floor of the internal chamber is defined by the interior surface 318 of the end cover 319. The interior surface of the end cover has a second series of grooves 320 formed therein to create the bottom section of the lower labyrinth seal 321. Other configurations of labyrinth seals or other seal means of restricting the intrusion of fluid well known in the art are envisioned by the present invention. Extending from the end cover is a conduit section 322, which defines the exhaust port 323.

Figure 4D:
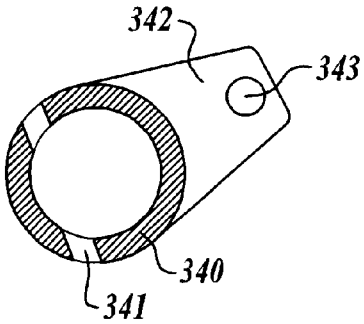
FIG. 4D depicts an exploded view of a cross-sectional side perspective of the Fluid Turbine.
Figure 4E:
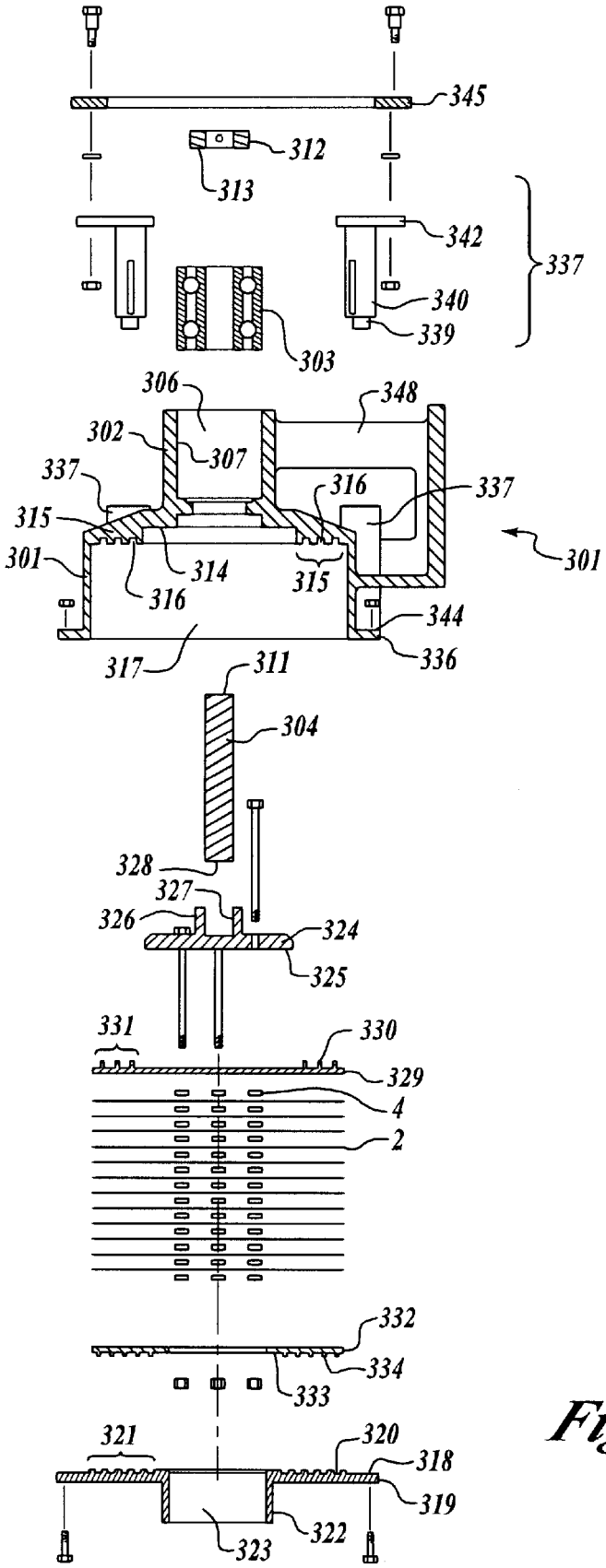
FIG. 4E is an exploded illustration of a cross-sectional side view of the fluid turbine.

The impeller assembly for the Fluid Turbine has several modifications to the sub-components. In particular, the central hub comprises two components, the straight shaft section 304 fixedly attached to a hub 324. An alternative design may employ a hub-plate design as described in the Hydroelectric Turbine embodiment. The hub has a support collar section 326 having an interior wall 327 forming a cavity to receive the connecting end 328 of the shaft. The shaft section may be joined to the hub by any conventional means to form a tight association, including threaded, welded, bonded, compression connections and the like. Alternatively, the shaft and the hub may be cast and/or machined as one integral piece, or as machined or cast sub-components. The interior face of the hub 325 is in tight association with the outside face the top reinforcing backing plate section 329. The outside face of the top reinforcing backing plate extending beyond the hub has a first series of raised grooves 330 to form the bottom section 331 of the upper labyrinth seal. The first series of raised ridges fit into the complementary first set of grooves 316 of the top section of the upper labyrinth seals 315. This configuration, as well as similar configurations, and other sealing devices well known in the art and serve to restrict the movement of fluid beyond the seal, thereby keeping more fluid flowing over the disks and out the exhaust port. The modified impeller assembly of the Fluid Turbine shares the same configuration of disks, spacers, connecting rods, etc as previously described. The aforementioned components for the Fluid Turbine may require different dimensions and stronger materials to accommodate the greater mechanical stresses of the system. In general the number of disks, disk dimensions and inter-disk spacing described above apply for the present embodiment, although due to the unique physical attributes of fluid, the inter-disk spacing may be in the range of 1/16 to ½ inch. The inlet side backing plate 12 described in previous embodiments has been replaced with a bottom reinforcing/labyrinth seal plate 332. The lower face 333 of the bottom reinforcing/labyrinth seal plate has a second plurality of raised ridges 334 that fit into the complementary grooves 320 of the bottom section of the lower labyrinth seal, forming the lower labyrinth seal. As shown in FIG. 4D, the end cover 319 is fixedly attached to the flange section 336 of the main housing by any conventional means known in the art, including, but not limited to, the nut and bolt arrangement depicted in the illustration. In addition, any conventional means of sealing the end cover to the main housing are envisioned, such as gaskets, o-rings and the like.

The main housing of the Fluid Turbine has a plurality of reversing nozzle housings 337 that are integral with the bell-shaped portion of the main housing, such that the interior of the reversing nozzle housings are open to the internal chamber 317 of the main housing. The openings of the reversing nozzle housings serve as a series of inlets for the fluid. A plurality of reversing nozzles 338 (FIG. 4C) are set into a complementary plurality of reversing nozzle housings by means of a mounting post 339 that is pivotally mounted into the base of the reversing nozzle housing 344. The body 340 of the reversing nozzles defines a conduit having a series of slots 341 through which fluid is directed. A controlling mechanism, such as a shifting ring, or other device, regulates the reversing nozzles. In this particular embodiment, the reversing nozzles are rotated by means of a shifting ring 345, as shown in FIG. 4B. The sifting ring is fixedly attached to the arm portion of the cap 342 of the reversing nozzles by any conventional means; for example, a bolt assembly through an aperture in the cap 343 and a complementary aperture in the shifting ring. The reversing nozzles are arranged in the reversing nozzle housings such that the slots may be exposed to the impeller assembly within the internal chamber of the housing by turning the shifting ring.

A fluid source is connected by any conventional means to the fluid inlet conduit 346, having a plurality of fluid supply conduits 347 branching to, and connecting with, the reversing nozzles. In operation, fluid of sufficient pressure is channeled into the fluid inlet conduit, where it is directed to the supply conduits and into the reversing nozzles. To engage the impeller assembly, the shifting ring is turned to adjust the reversing nozzles to align the complementary slots of each nozzle with the internal chamber of the main housing. The fluid is forced through the slots into the internal chamber and where the fluid contacts the impeller assembly.

The tortuous path of the upper and lower labyrinth seals creates a physical obstacle to the fluid, causing the fluid to preferentially move across the disks of the impeller assembly. The pressurized fluid initially contacts the outside perimeter of the disks 49 (refer to FIG. 1B), moves across the viscous drag face 48 of the disks to the inside perimeter 50, and through the central aperture 51 of the impeller assembly. The fluid continues to flow from regions of high to low pressure until eventually expelled from the exhaust port 323. As the fluid moves across the disks, energy is transferred to the impeller assembly through the friction of the fluid in immediate contact with the face of the disks in combination with the adhesive forces of the fluid, causing a continuously decreasing velocity in the fluid as it moves to the inside perimeter of the disks. The energy transferred to the disks from the moving fluid is predominantly in the form of tangential and rotational forces imparted to the disks, which cause the entire impeller assembly to rotate around its central axis. The bearing assembly 303 supports the shaft of the impeller assembly and permits rotational movement of the shaft 304 with a minimum of non-rotational movement. The receiving end of the shaft 311 may be connected by any conventional means known in the art to any number of mechanical devices for utilizing or applying the rotational movement produced thereby.

The reversing nozzles serve to regulate the speed, torque and direction of rotation of the turbine. In the preferred embodiment, the reversing nozzles have two slots, although additional slots and arrangements of slots may be used. The turbine is capable of reversing direction depending on which of the slots are aligned with the central chamber. As shown in FIG. 4B, the slots are opened to direct the fluid at various angles less than perpendicular to the disks of the impeller assembly, thereby imparting rotational movement in the direction of the arrow 349. To reverse the direction of the turbine, the shifting ring is turned to rotate the reversing nozzles and thereby align the opposite slots of the reversing nozzles with the internal chamber of the housing. The fluid is thereby directed in an opposite direction as previously described and imparts rotational movement of the impeller assembly counter to the arrow. The torque and rotational speed of the impeller assembly is controlled by adjusting the slots of the reversing nozzles relative to the disks of the impeller assembly. As the reversing nozzles are turned, the relative angle of the streaming fluid from the slots varies in relation to the disks (FIG. 4B). As the fluid contacts the disks at a more tangential angle, the turbine has less rotational speed, but greater torque, and when the streaming fluid contacts the disks at a more perpendicular angle, the turbine has greater rotational speed and less torque. As a result, the rotational speed can be finely adjusted by varying the angle of the streaming fluid relative to the disks by rotating the reversing nozzles. The fluid travels across the disks to the central cavity of the impeller assembly and eventually to the exhaust port 323, where it is expelled. The shifting ring may be turned to close both slots of the reversing nozzles to the internal chamber and consequently stop the turbine altogether. In addition, the shifting ring, or comparable device, may be controlled by any suitable means, including manually or mechanically, as well as work in association with regulating devices that monitor speed and direction and provide a reporting signal to controlling mechanisms to mechanically adjust the shifting ring and nozzles.

Turbine Transmission

Figure 5:
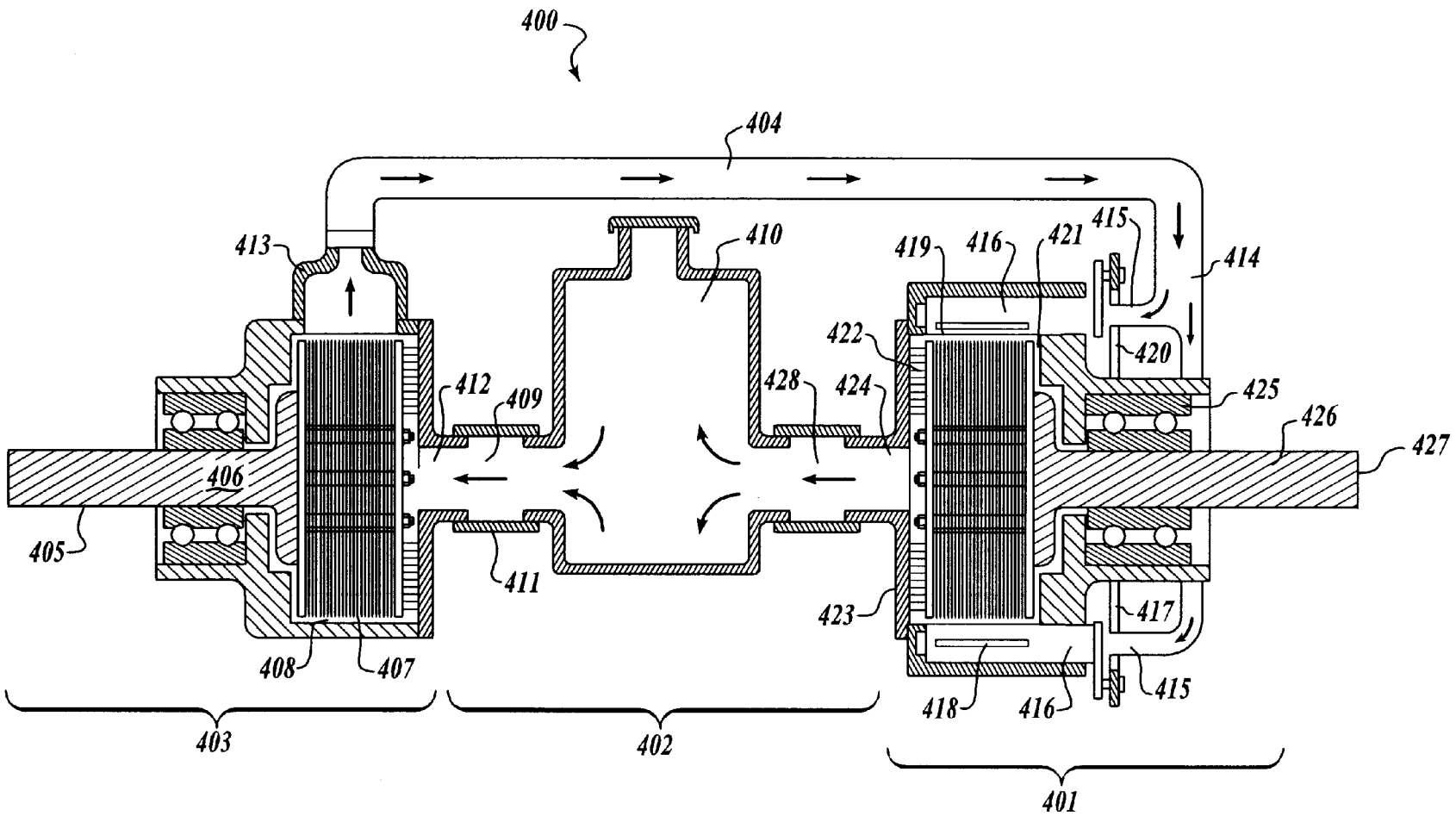
FIG. 5 illustrates a cross-sectional side perspective of a turbine transmission.

A turbine transmission 400, as illustrated in FIG. 5A, comprises a turbine section 401, a sump assembly 402, a pump section 403 and a high pressure line 404. The aforementioned subsystems are combined to form one closed system through which a fluid medium flows. Many of the features of the sub-components of the turbine transmission have been described in the detailed description of the Turbopump and the Fluid Turbine, and therefore those figures and detailed descriptions are incorporated herein.

Operationally, the turbine transmission is filled with a suitable fluid medium and devoid of any air. A drive system is activated to impart radial movement to the shaft 405 of the central hub 406, turning the stacked array of disks 407 through the fluid medium. As the disks of the impeller assembly are driven through the fluid medium, the fluid in immediate contact with the viscous drag face of the disks is also rotated due to the strong adhesion forces between the fluid and disk. As previously described, the fluid is subjected to two forces, one acting tangentially in the direction of rotation, and the other centrifuigally in an outward radial direction. The combined effects of these forces propel the fluid with continuously increasing velocity in a spiral path The fluid increases in velocity as it moves through the narrow inter-disk spaces causing zones of negative pressure at the inter-disk spaces. The continued movement of the accelerating fluid from the inside perimeter of the disks to the outside perimeter of the disks further draws fluid from the central cavity of the impeller assembly, which is continuous with the inlet port conduit of the inlet port. The net negative pressure created within the internal chamber 408 of the pump section continuously draws fluid from the inlet conduit leading from the sump 410 and connected, by any conventional means 411, to the inlet port 412 of the pump section 403.

As fluid is accelerated through the inter-disk spaces to the outside perimeter of the disks, the continued momentum drives the fluid against the inner wall of the housing chamber creating a zone of higher pressure defined by the gap between the outside perimeter of the disks and the inner wall of the housing chamber. The fluid is driven from the zone of relative high pressure to a zone of relatively lower pressure defined by the outlet port 413 and the high pressure line 404 connected thereto (as illustrated by the arrows).

The pressurized fluid is driven through the high pressure line to the fluid inlet line 414 and to the branching supply lines 415, which connect to the cap sections of the reversing nozzles 416, as previously described in the Fluid Turbine embodiment. To engage the impeller assembly, the shifting ring 417 is turned to adjust the reversing nozzles to align the complementary slots 418 of each nozzle with the internal chamber 419 of the turbine housing 420. The fluid is forced through the slots into the internal chamber and contacts the impeller assembly. The tortuous path of the upper 421 and lower 422 labyrinth seals creates a physical obstacle to the fluid, causing it to preferentially move across the disks 423 of the impeller assembly. The pressurized fluid initially contacts the outside perimeter of the disks, moves across the viscous drag face of the disks to the inside perimeter, and through the central aperture of the impeller assembly. The fluid continues to flow from regions of high to low pressure until eventually expelled from the exhaust port 424. As the fluid moves across the disks, energy is transferred to the impeller assembly through the friction of the fluid in immediate contact with the face of the disks in combination with the adhesive forces of the fluid, causing a continuously decreasing velocity in the fluid as it moves to the inside perimeter of the disks. The energy transferred to the disks from the moving fluid is predominantly in the form of tangential and rotational forces imparted to the disks, which cause the entire impeller assembly to rotate around its central axis. The bearing assembly 425 supports the shaft 426 of the impeller assembly and permits rotational movement of the shaft with a minimum of non-rotational movement. The receiving end of the shaft 427 may be connected by any conventional means known in the art to any number of mechanical devices for utilizing or applying the rotational movement produced thereby.

As described above, the reversing nozzles serve to regulate the speed, torque and direction of rotation of the turbine. The turbine is capable of reversing direction depending on which of the slots are aligned with the central chamber. The torque and rotational speed of the impeller assembly is controlled by adjusting the slots of the reversing nozzles relative to the disks of the impeller assembly. As the reversing nozzles are turned, the relative angle of the streaming fluid from the slots varies in relation to the disks, thereby controlling rotational speed and torque. The shifting ring can be turned to close both slots of the reversing nozzles to the internal chamber and consequently stop the turbine, and therefore, the transmission completely. In addition, the shifting ring, or comparable device, may be controlled by any suitable means, including manually or mechanically, as well as work in association with regulating devices that monitor speed and direction and provide a reporting signal to controlling mechanisms to mechanically adjust the shifting ring and nozzles.

The fluid is driven across the disks of the turbine to the central cavity of the impeller assembly and eventually driven out the exhaust port 424 and on through the outlet conduit 428 connected by any conventional means 429 to the sump 410. The fluid expelled from the turbine is driven into the sump where it is recycled. The fluid is eventually drawn back into the pump section, where the cycle repeats itself. The drive mechanism applying rotational movement to the impeller assembly of the pump section drives the fluid to impart rotational movement of the impeller assembly of the turbine section thereby providing complementary rotational movement at the turbine's shaft, which may be utilized in any number of ways.

While in the foregoing specification this invention has been described in relation to certain preferred embodiments thereof, and many details have been set forth for purpose of illustration, it will be apparent to those skilled in the art that the invention is susceptible to various changes and modification as well as additional embodiments and that certain of the details described herein may be varied considerably without departing from the basic spirit and scope of the invention.

EXAMPLES

Example 1

Comparison of Viscous Drag Pump with Conventional Vane-type Pump

A direct comparison of a standard pump, which utilized a typical rotor assembly with vanes, was tested against the present invention. Two identical ⅛ horsepower 3650 rpm motors were fitted with different impeller assemblies. Pump A possessed a conventional vane-type rotor assembly, and pump B possessed the viscous drag impeller assembly. To determine the comparative efficiency of the two types of pumps, the amount of waste oil pumped over time was monitored. The standard pump was unable to transfer the waste oil and was shown to severely overheat during the course of the trial. In contrast, the pump utilizing the viscous drag assembly was able to circulate the oil without strain on the motor.

To facilitate circulation of the viscous fluid and thereby compare the relative efficiency of the two pump designs, the waste oil was heated to 140 F. The pump equipped with the viscous drag assembly was able to transfer three gallons/minute in contrast to only one gallon/minute for the standard pump.

What is claimed is:

1. An impeller assembly, comprising:

(a) a central hub;

(b) a first reinforcing backing plate fixedly connected to the central hub;

(c) a stacked array of parallel disks arranged on the central hub and fixedly connected to the first reinforcing backing plate, wherein each of the disks possesses a central aperture, the central apertures are aligned in the stacked array producing a central cavity, and wherein the disks are inter-spaced along a parallel axis and connected to one another at locations that protrude into the central aperture in proximity to an interior perimeter of each disk;

(d) a second reinforcing backing plate fixedly attached to the stacked array of parallel disks, wherein the second reinforcing backing plate possesses a central aperture, whereby, upon radial movement of the central hub, a fluid flows through the central apertures of the second reinforcing backing plate and the stacked array of disks and the spaces between the disks.

2. The impeller assembly according to claim 1, further comprising a series of connecting rods to fixedly connect the central hub, the first and second reinforcing backing plates and the stacked array of disks.

3. The impeller assembly of claim 1, further comprising a series of spacers having a central aperture, wherein the spacers are fixedly connected to the disks, creating spaces between the disks.

4. A pump, comprising:

(a) the impeller assembly of claim 1, wherein the central hub has a shaft section and a flange section;

(b) a housing in which the impeller assembly is contained, creating a complementary surface for the impeller assembly, and wherein a gap is established between the impeller assembly and the housing, defining a zone of high pressure, wherein the housing has an inlet port and an outlet port; and (c) a bearing assembly retained in the housing and in tight association with the shaft section of the central hub for retaining and supporting the impeller assembly, wherein the impeller assembly is radially driven to draw fluid from the inlet port into the central apertures of the backing plate and along the disks and propelled under pressure to the outlet port.

5. A Turbine Transmission, comprising:

(a) a pump comprising an impeller assembly having a central hub; a first reinforcing backing plate fixedly connected to the central hub; a stacked array of parallel disks arranged on the central hub and fixedly connected to the first reinforcing backing plate, wherein each of the disks possesses a central aperture, the central apertures are aligned in the stacked array producing a central cavity, and wherein the disks are inter-spaced along a parallel axis and connected to one another in proximity to an interior perimeter of each disk; and a second reinforcing backing plate fixedly attached to the stacked array of parallel disks, wherein the second reinforcing backing plate possesses a central aperture, whereby, upon radial movement of the central hub, a fluid flows through the central apertures of the second reinforcing backing plate and the stacked array of disks and the spaces between the disks, wherein the central hub has a shaft section and a flange section, a housing in which the impeller assembly is contained, creating a complementary surface for the impeller assembly, and wherein a gap is established between the impeller assembly and the housing, defining a zone of high pressure, wherein the housing has an inlet port and an outlet port, and a bearing assembly retained in the housing and in tight association with the shaft section of the central hub for retaining and supporting the impeller assembly, wherein the impeller assembly is radially driven to draw fluid from the inlet port into the central apertures of the backing plate and along the disks and propelled under pressure to the outlet port;

(b) a fluid turbine comprising an impeller assembly having a central hub; a first reinforcing backing plate fixedly connected to the central hub; a stacked array of parallel disks arranged on the central hub and fixedly connected to the first reinforcing backing plate, wherein each of the disks possesses a central aperture, the central apertures are aligned in the stacked array producing a central cavity; and wherein the disks are inter-spaced along a parallel axis and connected to one another in proximity to an interior perimeter of each disk; and a second reinforcing backing plate fixedly attached to the stacked array of parallel disks, wherein the second reinforcing backing plate possesses a central aperture, whereby, upon radial movement of the central hub, a fluid flows through the central apertures of the second reinforcing backing plate and the stacked array of disks and the spaces between the disks, wherein the central hub has a shaft section and a flange section, a housing in which the impeller assembly is contained, creating a complementary surface for the impeller assembly, wherein the housing has a plurality of reversing nozzle housing providing a plurality of inlets, and wherein the housing has an outlet port, a plurality of reversing nozzles contained within the reversing nozzle housings, a controlling mechanism connected to the plurality of reversing nozzles such that the position of the reversing nozzles is adjustable, a fluid inlet conduit connected to the reversing nozzles, and a bearing assembly retained in the housing and in tight association with the shaft section of the central hub for retaining and supporting the impeller assembly, wherein the impeller assembly is radially driven by the fluid flowing from the reversing nozzles and through the inlets across the disks of the impeller assembly and eventually discharged from the outlet port; reinforcing backing plate, wherein each of the disks possesses a central aperture, the (c) a sump section having a sump inlet conduit connected to the inlet port of the pump, and wherein the sump section has an sump outlet conduit connected to the exhaust port of the fluid turbine; and (d) a high pressure line connecting the exhaust port of the pump and the fluid inlet conduit of the fluid turbine, such that a closed system is created, and whereby fluid is drawn from the sump section through the sump inlet conduit and inlet port of the pump and driven by the impeller assembly out the exhaust port of the pump through the high pressure line to the fluid inlet conduit to the reversing nozzles whereby the impeller assembly of the turbine is radially driven and the fluid is eventually exhausted through the exhaust port of the turbine through the sump outlet conduit such that the fluid is continuously recycled.

6. A method for displacing fluids, which comprises:

(a) priming the pump of claim 4;

(b) radially driving the impeller assembly;

(c) drawing fluid from the inlet port into the housing through the central apertures of the backing plate and disks and along the disks;

(d) propelling the fluid through the impeller assembly to the high pressure zone at the gap between the complementary surface of the housing and the impeller assembly; and (e) driving the fluid through the exhaust port of the housing, whereby the fluid is continuously drawn into the inlet port and exhausted through the outlet port.

7. A marine jet pump, comprising:

(a) the impeller assembly of claim 1, wherein the central hub has a shaft section and a flange section;

(b) a housing in which the impeller assembly is contained, creating a complementary surface for the impeller assembly, and wherein a gap is established between the impeller assembly and the housing, defining a zone of high pressure, wherein the housing has an outlet port;

(c) a cover fixedly attached to the housing, having a cowl section, wherein the cowl section has an inlet port; and (d) a bearing assembly retained in the housing and in tight association with the shaft section of the central hub for retaining and supporting the impeller assembly, wherein the impeller assembly is radially driven to draw fluid from the inlet port into the central apertures of the backing plate and along the disks and propelled under pressure to the outlet port.

8. A hydroelectric turbine, comprising:

(a) the impeller assembly of claim 1, wherein the central hub has a shaft section and a flange section, and wherein the first reinforcing backing plate is integral with the central hub;

(b) a housing in which the impeller assembly is contained creating a complementary surface for the impeller assembly, wherein the housing has a penstock and an outlet port;

(c) a plurality of wicket gates pivotably connected to the housing such that the flow of the fluid to the impeller assembly is regulated;

(d) a controlling mechanism connected to the plurality of wicket gates such that the position of the wicket gates is adjustable; and (e) a bearing assembly retained in the housing and in tight association with the shaft section of the central hub for retaining and supporting the impeller assembly, wherein the impeller assembly is radially driven by the fluid flowing from the penstock through the wicket gates across the disks of the impeller assembly and eventually discharged from the outlet port.

9. A fluid turbine, comprising:

(a) an impeller assembly comprising a central hub; a first reinforcing backing plate fixedly connected to the central hub; a stacked array of parallel disks arranged on the central hub and fixedly connected to the first reinforcing backing plate, wherein each of the disks possesses a central aperture, the central apertures are aligned in the stacked array producing a central cavity, and wherein the disks are inter-spaced along a parallel axis and connected to one another in proximity to an interior perimeter of each disk; and a second reinforcing backing plate fixedly attached to the stacked array of parallel disks, wherein the second reinforcing backing plate possesses a central aperture, whereby, upon radial movement of the central hub, a fluid flows through the central apertures of the second reinforcing backing plate and the stacked array of disks and the spaces between the disks, wherein the central hub has a shaft section and a flange section;

(b) a housing in which the impeller assembly is contained creating a complementary surface for the impeller assembly, wherein the housing has a plurality of reversing nozzle housings providing a plurality of inlets, and wherein the housing has an outlet port;

(c) a plurality of reversing nozzles contained within the reversing nozzle housings;

(d) a controlling mechanism connected to the plurality of reversing nozzles such that the position of the reversing nozzles is adjustable;

(e) a fluid inlet conduit connected to the reversing nozzles; and (f) a bearing assembly retained in the housing and in tight association with the shaft section of the central hub for retaining and supporting the impeller assembly, wherein the impeller assembly is radially driven by the fluid flowing from the reversing nozzles and through the inlets across the disks of the impeller assembly and eventually discharged from the outlet port.

10. A method for transferring mechanical power from a propelled fluid, comprising:

(a) channeling a propelled fluid to the turbine according to claim 8 or 9;

(b) directing the flow of fluid to the impeller assembly such that the fluid imparts radial movement to the impeller assembly; and (c) exhausting the fluid through the exhaust port, whereby the kinetic energy of the fluid is transferred to radial movement of the impeller assembly.

11. An impeller assembly comprising a stacked array of disks, the disks arranged parallel to one or more neighboring disks and separated from one or more neighboring disks by an interdisk space; the disks having a central aperture, with the central apertures of the stacked array of disks aligned to form a central cavity; the disks connected to one or more neighboring discs at a location that protrudes into the central aperture.

12. An impeller assembly according to claim 11, additionally comprising a central hub mounted to the stacked array of disks and a drive means for rotating the central hub.

13. An impeller assembly according to claim 11, additionally comprising a housing forming an interior chamber of sufficient volume to accommodate the stacked array of disks and sized to maintain a gap between an outer periphery of the stacked array of disks and an inner periphery of the housing.

14. An impeller system according to claim 1 or 13, wherein the interdisk space is maintained by spacers mounted between disks.

15. An impeller system according to claim 1 or 13, wherein the interdisk space between each of the disks forming the stacked array is equal.

16. An impeller system according to claim 1 or 13, wherein the interdisk space between each of the disks forming the stacked array is from 1/16 to 1 inch.

17. An impeller system according to claim 1 or 13, wherein the interdisk space between each of the disks forming the stacked array is from 1/8 to 1/2 inch.

18. An impeller system according to claim 1 or 13, comprising from 4 to 40 disks.

19. A pump comprising an impeller assembly of claim 1 or 11, mounted in a housing having a fluid intake conduit and an exhaust port provided in proximity to a directional nozzle to direct an exhaust fluid stream.

20. A hydroelectric turbine comprising an impeller assembly of claim 1 or 11.

21. A fluid turbine comprising an impeller assembly of claim 1 or 11.

22. A turbine transmission comprising an impeller assembly of claim 1 or 11.

23. In a device comprising a stacked array of parallel disks having central apertures for transferring mechanical power through a fluid medium, the improvement comprising: providing a central cavity by aligning the central apertures of the array of disks and interconnecting the parallel disks to one another at a location in proximity to the central cavity.

24. A method for displacing fluids, comprising: introducing a fluid to a fluid inlet port of a housing containing an impeller assembly of claim 1 or 11, rotating the impeller assembly, and releasing fluid through an outlet port.

* * * * *